US008913927B2

(12) United States Patent
Oda et al.

(10) Patent No.: US 8,913,927 B2
(45) Date of Patent: Dec. 16, 2014

(54) DEVELOPER CARTRIDGE, DEVELOPING DEVICE AND IMAGE FORMING APPARATUS

(75) Inventors: Yukiyoshi Oda, Tokyo (JP); Ken Nozawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 327 days.

(21) Appl. No.: 13/405,684

(22) Filed: Feb. 27, 2012

(65) Prior Publication Data

US 2012/0219328 A1 Aug. 30, 2012

(30) Foreign Application Priority Data

Feb. 28, 2011 (JP) ..... 2011-041623

(51) Int. Cl.
*G03G 15/06* (2006.01)
*G03G 15/08* (2006.01)
*G03G 21/16* (2006.01)

(52) U.S. Cl.
CPC ..... *G03G 15/0834* (2013.01); *G03G 15/0875* (2013.01); *G03G 21/1676* (2013.01); *G03G 2215/0673* (2013.01); *G03G 2215/068* (2013.01); *G03G 2215/0692* (2013.01); *G03G 2221/1654* (2013.01)
USPC ..... 399/260; 399/262; 399/114

(58) Field of Classification Search
CPC ..... G03G 21/1647; G03G 21/1676; G03G 15/0865; G03G 15/0875
USPC ..... 399/111, 114, 252, 258–260, 262
See application file for complete search history.

(56) References Cited

U.S. PATENT DOCUMENTS

| | | | | |
|---|---|---|---|---|
| 2009/0220250 | A1* | 9/2009 | Funahashi | 399/12 |
| 2010/0247160 | A1* | 9/2010 | Ohta et al. | 399/262 |
| 2011/0020014 | A1* | 1/2011 | Okamoto et al. | 399/12 |
| 2011/0052266 | A1* | 3/2011 | Yoon et al. | 399/258 |

FOREIGN PATENT DOCUMENTS

| | | | |
|---|---|---|---|
| JP | 2000-181224 | A | 6/2000 |
| JP | 2005-326772 | A | 11/2005 |
| JP | 2007-093737 | A | 4/2007 |

* cited by examiner

*Primary Examiner* — Walter L Lindsay, Jr.
*Assistant Examiner* — Jessica L Eley
(74) *Attorney, Agent, or Firm* — Rabin & Berdo, P.C.

(57) ABSTRACT

A developer cartridge is detachably mounted to a main apparatus, and includes a storage portion storing a developer, an ejection opening for ejecting the developer from the storage portion, and a first opening-and-closing member for opening and closing the ejection opening. The first opening-and-closing member is able to take a first position where the first opening-and-closing member opens the ejection opening and causes the developer cartridge to be fixed to the main apparatus, a second position where the first opening-and-closing member closes the ejection opening and makes the developer cartridge detachable from the main apparatus, and a third position where the first opening-and-closing member closes the ejection opening and causes the developer cartridge to be fixed to the main apparatus.

22 Claims, 25 Drawing Sheets

DEVELOPER CARTRIDGE, DEVELOPING DEVICE AND IMAGE FORMING APPARATUS

BACKGROUND OF THE INVENTION

The present invention relates to a developer cartridge for storing a developer, a developing device having the developer cartridge, and an image forming apparatus having the developing device.

An electrophotographic image forming apparatus such as a printer, copier, facsimile machine or the like is configured to form a visualized image by uniformly charging a surface of a photosensitive body, exposing the surface of the photosensitive body to form a latent image, developing the latent image to form a developer image, and transferring the developer image to a printing medium.

The image forming apparatus includes a developing device for developing the latent image. A developer cartridge is detachably mounted to a main body of the developing device for supplying a developer to the main body of the developing device.

For example, Japanese Laid-open Patent Publication No. 2000-181224 discloses a developer cartridge including a fresh developer storage portion and a waste developer collecting portion.

The image forming apparatus is transported in such a manner that the developing device is assembled therein. The developer cartridge is packaged, and attached to an outside of the image forming apparatus.

However, there is a also case where the image forming apparatus is transported in such a manner that the developer cartridge is mounted to the developing device in the image forming apparatus. In such a case, the developer cartridge needs be fixed to the developing device by fixing members such as tapes or pins. Therefore, when a user sets up the image forming apparatus, the user has to remove the fixing members or the like, and an operational burden on the user increases. Further, disposal of the removed fixing members requires cost and labor.

SUMMARY OF THE INVENTION

In an aspect of the present invention, it is intended to provide a developer cartridge, a developing device and an image forming apparatus configured so that the developer cartridge is mounted to a main body of the image forming apparatus with a simple structure.

According to an aspect of the present invention, there is provided a developer cartridge detachably mounted to a main apparatus. The developer cartridge includes a storage portion in which a developer is stored, an ejection opening for ejecting the developer from the storage portion, and a first opening-and-closing member for opening and closing the ejection opening. The first opening-and-closing member is able to take a first position where the first opening-and-closing member opens the ejection opening and causes the developer cartridge to be fixed to the main apparatus, a second position where the first opening-and-closing member closes the ejection opening and makes the developer cartridge detachable from the main apparatus, and a third position where the first opening-and-closing member closes the ejection opening and causes the developer cartridge to be fixed to the main apparatus.

With such a configuration, the developer cartridge can be fixed to the main apparatus (for example, a developing device, an image forming apparatus or the like) with a simple structure. Therefore, the image forming apparatus can be transported in a state where the developer cartridge is fixed to the developing device.

According to another aspect of the present invention, there is provided a developing device as the above described main apparatus to which the developer cartridge is mounted. The developing device includes a developing device main body to which the developer cartridge is detachably mounted.

According to still another aspect of the present invention, there is provided a developing device as the above described main apparatus to which the developer cartridge is mounted. The developing device includes a developing device main body to which the developer cartridge is detachably mounted. The first latch member is made of a resilient member. The first latch member can be released from the first stopper member by being deformed with a predetermined amount. When the first opening-and-closing member is in the third position, the first latch member is not deformed or is deformed with a smaller amount than the predetermined amount.

According to yet another aspect of the present invention, there is provided an image forming apparatus including the above described developing device, and an image forming portion in which a developer image developed by the developing device is formed on a printing medium.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

Configuration of Image Forming Apparatus

Figure 1:
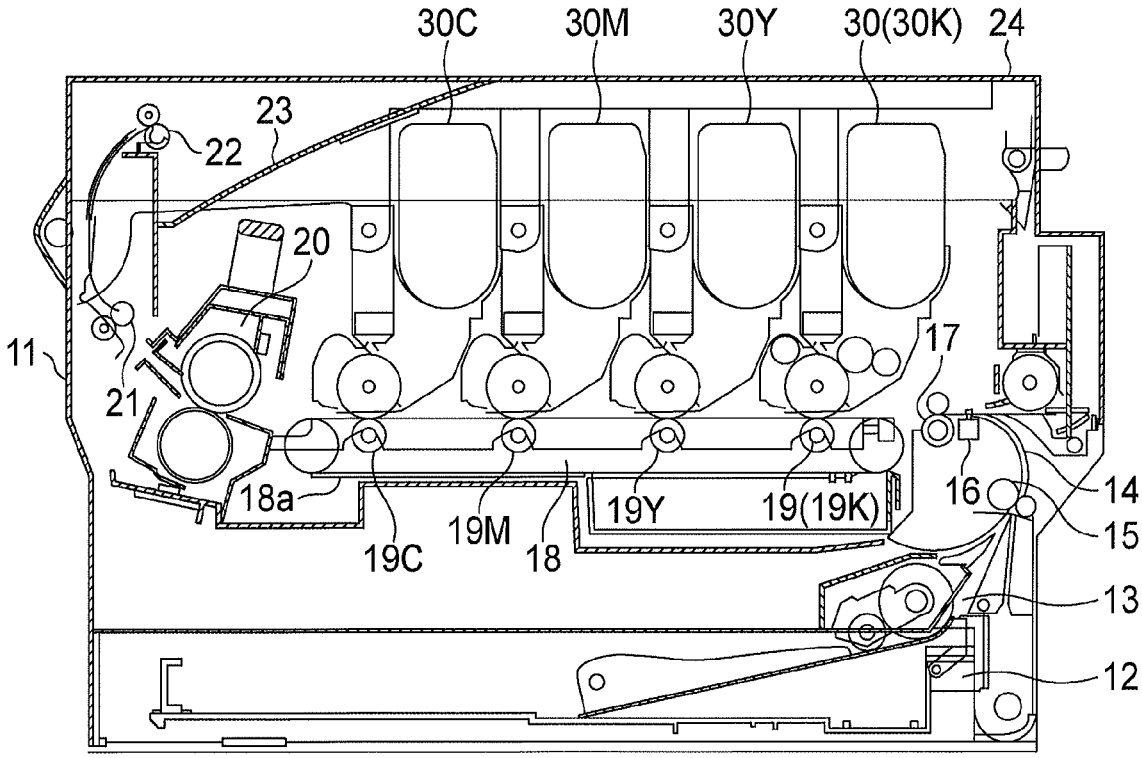
FIG. 1 is a schematic sectional view showing an image forming apparatus according to the first embodiment of the present invention.

FIG. 1 is a schematic sectional view showing an image forming apparatus according to the first embodiment of the present invention. The image forming apparatus is configured as, for example, an electrophotographic color page printer. The image forming apparatus (i.e. a main apparatus) includes a frame 11 and an upper cover 24 that constitute a housing of the image forming apparatus. A feeding tray 12 is mounted on a lower part of the frame 11. The feeding tray 12 stores sheets P (see FIG. 2) as printing media. A hopping roller 13 is provided above an end of the feeding tray 12. The hopping roller 13 is configured to feed the sheets P one by one from the feeding tray 12. A feeding guide 14 and a pair of conveying rollers 15 are provided on a sheet feeding side of the hopping roller 13. The feeding guide 14 guides the sheet P fed by the hopping roller 13. The conveying rollers 15 convey the sheet P along the feeding guide 14. A detecting unit 16 and a pair of conveying rollers 17 are provided on a downstream side of the conveying rollers 15 in a conveying direction of the sheet P. The detecting unit 16 detects a thickness of the sheet P. The conveying rollers 17 convey the sheet P to a transfer belt unit 18 described below.

The transfer belt unit 18 includes a transfer belt 18*a* that electrostatically absorbs and conveys the sheet P. The transfer belt unit 18 further includes a driving roller 18*b* and a tensioning roller 18*c* around which the transfer belt 18*a* is stretched. The driving roller 18*b* rotates to move the transfer belt 18*a*. The tensioning roller 18*c* applies tension to the transfer belt 18*a*. The transfer belt unit 18 further includes a plurality of (for example, four) transfer members 19K, 19Y, 19M and 19C described later.

Developing devices 30K, 30Y, 30M and 30C (also referred to as process units) are provided above the transfer belt unit 18. The developing devices 30K, 30Y, 30M and 30C are configured to form developer images (i.e., toner images) of respective colors (for example, black, yellow, magenta and cyan). The developing devices 30K, 30Y, 30M and 30C are arranged from upstream to downstream along a conveying path of the sheet P (i.e., a sheet conveying path). The developing devices 30K, 30Y, 30M and 30C have the same configuration except developers (toners). The above described transfer members 19K, 19Y, 19M and 19C are disposed below and facing the developing devices 30K, 30Y, 30M and 30C.

A fixing unit 20 is provided on a downstream side of the developing device 30C along the sheet conveying path. The fixing unit 20 includes a heating roller and a pressure roller which apply heat and pressure to the sheet P so as to fix the developer image to the sheet P.

Two pairs of ejection rollers 21 and 22 are provided on a downstream side of the fixing unit 20 along the sheet conveying path. The ejection rollers 21 and 22 eject the sheet P to which the developer image is fixed to outside the image forming apparatus. A stacker 23 is provided on the upper cover 24 for placing the ejected sheet P thereon.

The developing devices 30K, 30Y, 30M and 30C have the same configuration except developers, and therefore are collectively referred to as "the developing device 30".

Figure 2:
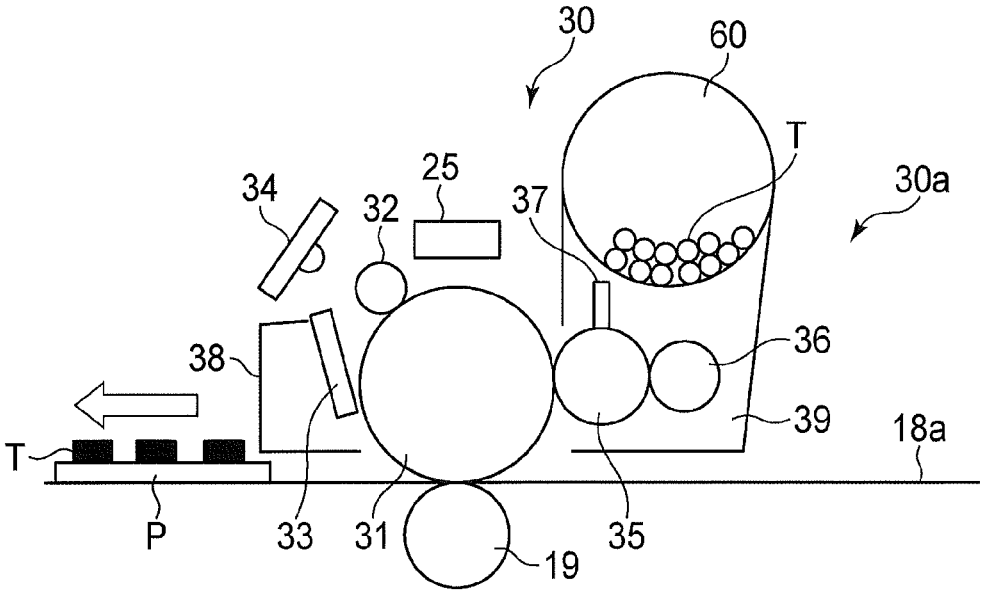
FIG. 2 is an enlarged schematic sectional view showing a developing device, a transfer member and a printing medium according to the first embodiment.

FIG. 2 is an enlarged schematic view showing the developing device 30, the transfer member 19 and the sheet P shown in FIG. 1.

The developing device 30 (i.e., a main apparatus) includes a developing device main body 30*a* and a developer cartridge 60 for supplying a developer P to the developing device main body 30*a*.

The developing device main body 30*a* includes a photosensitive body 31 as an image bearing body, a charging member 32 for uniformly charging a surface of the photosensitive body 31, a developing roller 35 as a developer bearing body, a supplying roller 36 as a developer supplying member, and a developing blade 37 as a layer forming member (or thin layer forming member). The developing device main body 30*a* also includes a cleaning blade 33 as a cleaning member for scraping off the developer T from the photosensitive body 31, and a developer storage portion 39 for storing the developer T. The developing roller 35, the supplying roller 36 and the developing blade 37 are disposed in the developer storage portion 39. An exposure unit 25 (for example, a light source) is provided above the photosensitive drum 31. The exposure unit 28 is configured to emit light to expose the surface of the photosensitive drum 31 so as to form a latent image on the surface of the photosensitive drum 31. The developing device main body 30*a* is enclosed by a frame 38.

The photosensitive drum 31 includes a metal pipe (i.e., a conductive support) made of aluminum, and a photoconductive layer formed on the metal pipe. The photoconductive layer includes a charge generation layer and a charge transport layer laminated on the conductive support. The charging roller 32 includes, for example, a metal shaft and a semiconductive rubber provided around the metal shaft. The developing roller 33 includes a metal shaft and a semiconductive urethane rubber layer provided around the metal shaft.

The supplying roller 36 has a semiconductive foamed silicone sponge layer. The developing blade 37 is made of stainless steel.

Figure 3:
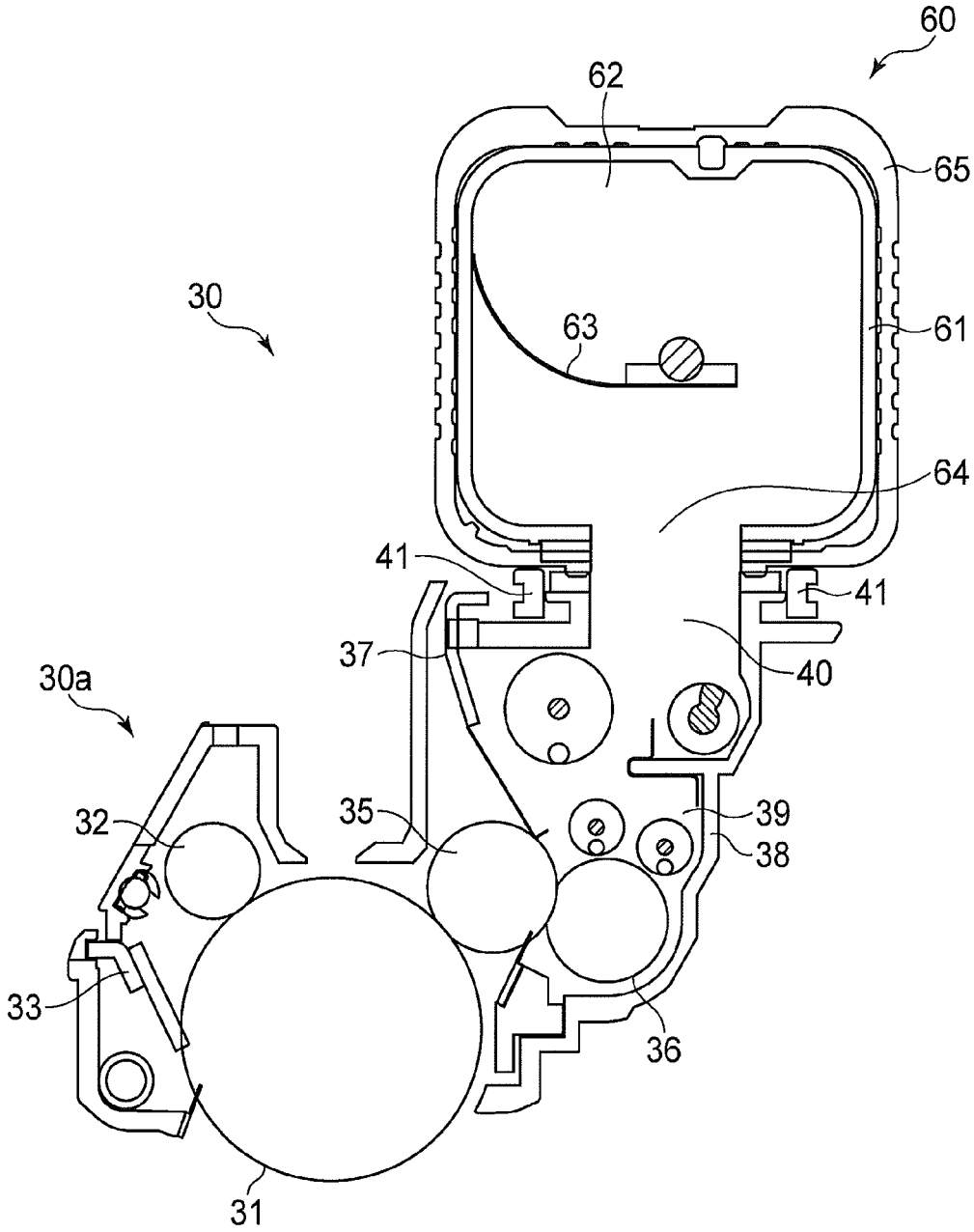
FIG. 3 is a sectional view showing the developing device in which a developer cartridge is mounted to a developing device main body.
Figure 4A:
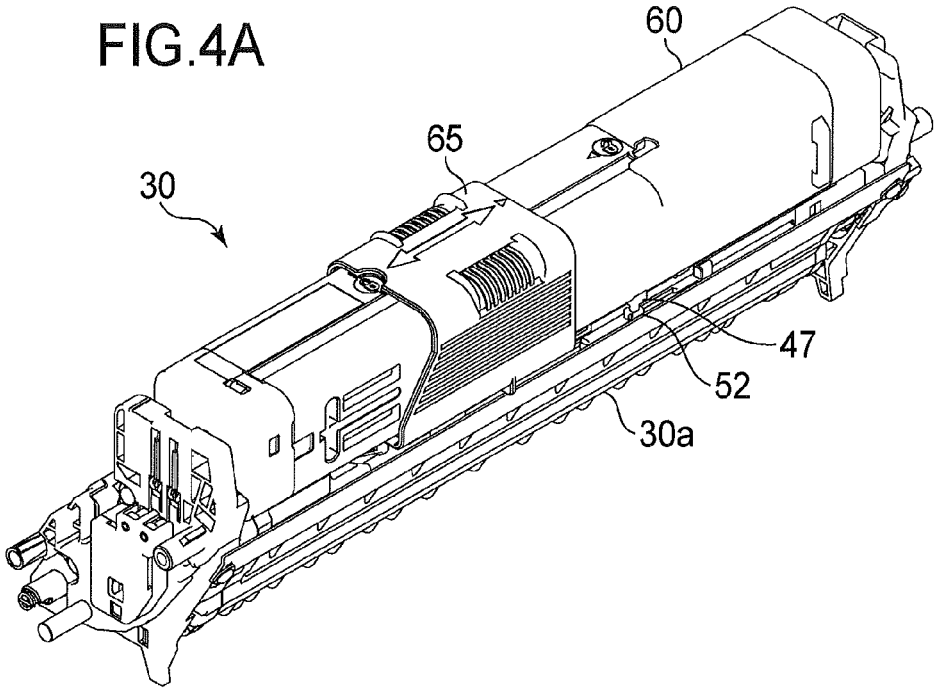
FIGS. 4A and 4B are top perspective views showing the developing device according to the first embodiment.
Figure 4B:
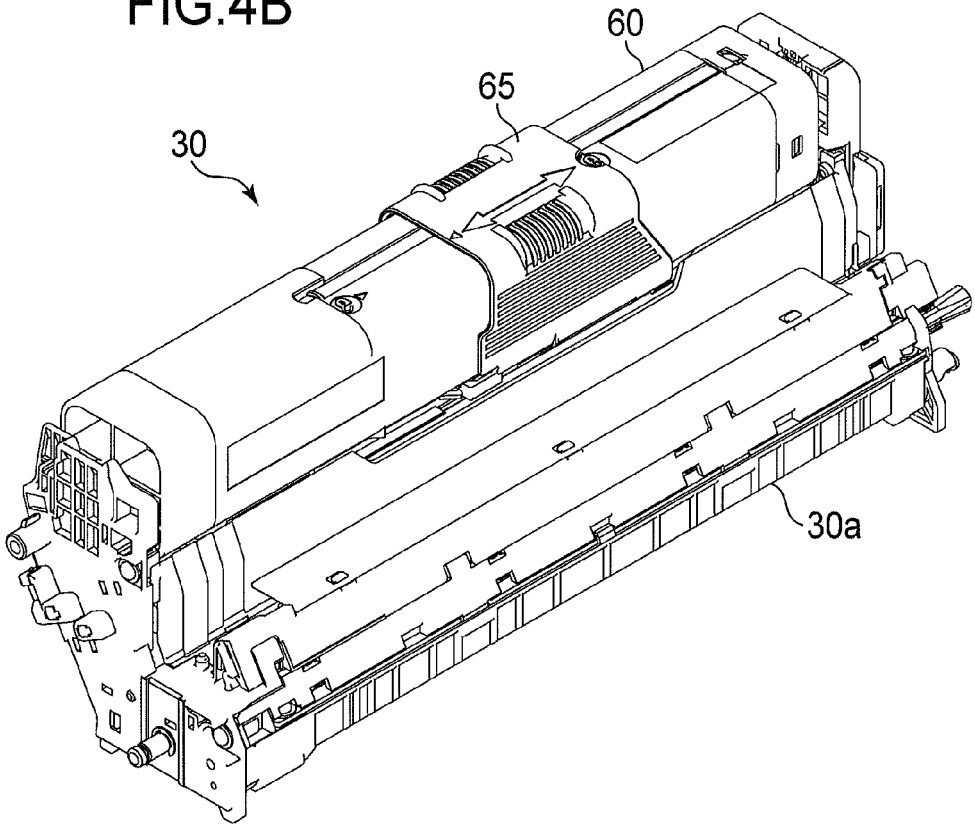

FIG. 3 is a sectional view showing the developing device 30 in which the developer cartridge 60 is mounted to the developing device main body 30*a*. FIGS. 4A and 4B are top perspective views showing the developing device 30 as seen in different directions.

The developer cartridge 60 includes a storage portion 62 in which a developer is stored. The storage portion 62 has a substantially cylindrical shape, and is detachably mounted to the developing device main body 30*a*. The developer cartridge 60 further includes an agitating bar 63 as a supplying mechanism rotatably provided in the storage portion 62. The agitating bar 63 extends in a longitudinal direction of the storage portion 62. A supplying opening 64 (i.e., an ejection opening) is provided on an outer circumference 61 of the developer cartridge 60 below the agitating bar 63. The developer stored in the storage portion 62 is ejected through the supplying opening 64. A first shutter member 65 as a first opening-and-closing member is slidably provided on the outer circumference 61 of the developer cartridge 60. The first shutter member 65 opens and closes the supplying opening 64.

The developing device main body 30*a* has a receiving opening 40 provided above the developer storage portion 39. The receiving opening 40 is connected to the supplying opening 64, and receives the developer ejected from the supplying opening 64. The developing device main body 30*a* further has a second shutter member 41 as a second opening-and-closing member slidably provided on the frame 38. The second shutter member 41 opens and closes the receiving opening 64.

Figure 5A:
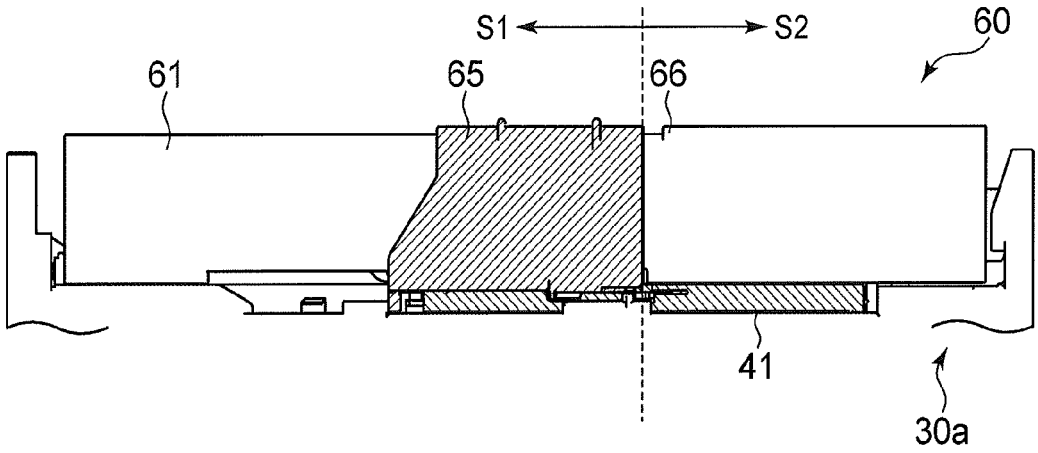
FIGS. 5A, 5B and 5C are schematic views showing positions of a first shutter member and a second shutter member according to the first embodiment.
Figure 5B:
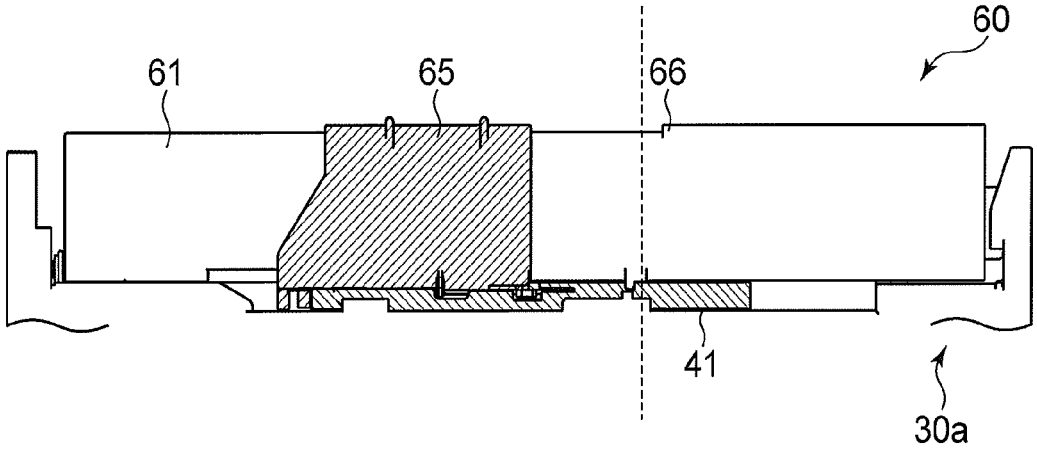
Figure 5C:
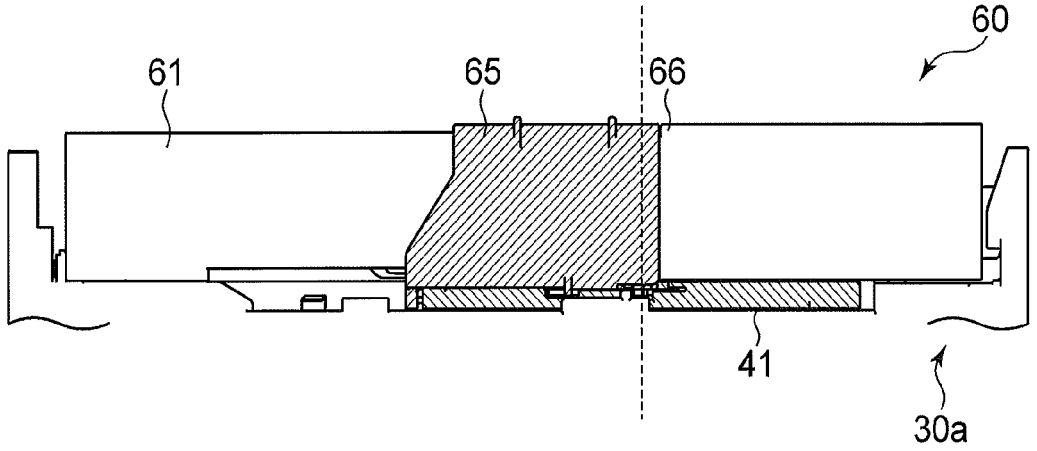

FIGS. 5A, 5B and 5C are schematic views showing positions of the first shutter member 65 and the second shutter member 41. As shown in FIGS. 5A, 5B and 5C, the first shutter member 65 of the developer cartridge 60 is able to take three positions in a state where the developer cartridge 60 is mounted to the developing device main body 30*a*.

FIG. 5A shows a second position (i.e., a detachable position) in which the supplying opening 64 is closed by the first shutter member 65, and the developer cartridge 60 is detachable from the developing device main body 30*a*.

FIG. 5B shows a first position (i.e., a printing enabling position) in which the developer cartridge 60 is fixed to the developing device main body 30*a*, and the supplying opening 64 and the receiving opening 40 are both opened.

FIG. 5C shows a third position (i.e., a fixing position) in which the developer cartridge 60 is fixed to the developing device main body 30*a*, and the supplying opening 64 and the receiving opening 40 are both closed.

The first position (FIG. 5B) is located on one side of the second position (FIG. 5A), and the third position (FIG. 5C) is located on the other side of the second position. In FIG. 5A, an arrow S1 indicates a direction in which the first shutter member 65 moves from the second position toward the first position (FIG. 5B), and an arrow S2 indicates a direction opposite to the direction S1.

Figure 6A:
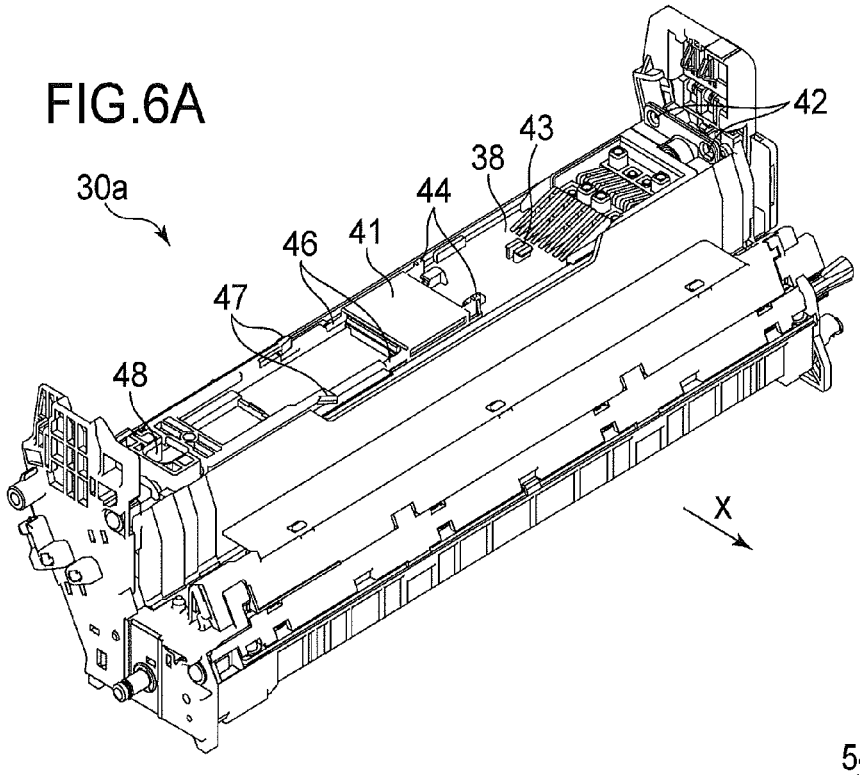
FIGS. 6A and 6B are top perspective views showing the developing device main body according to the first embodiment.
Figure 6B:
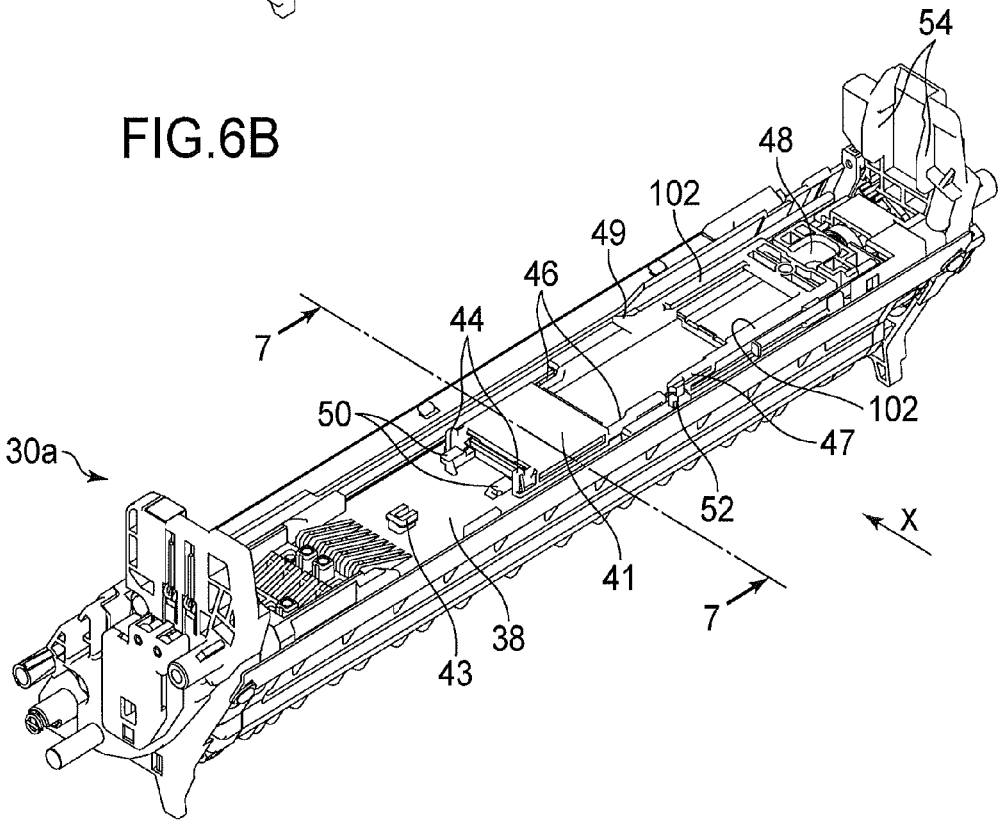
Figure 6C:
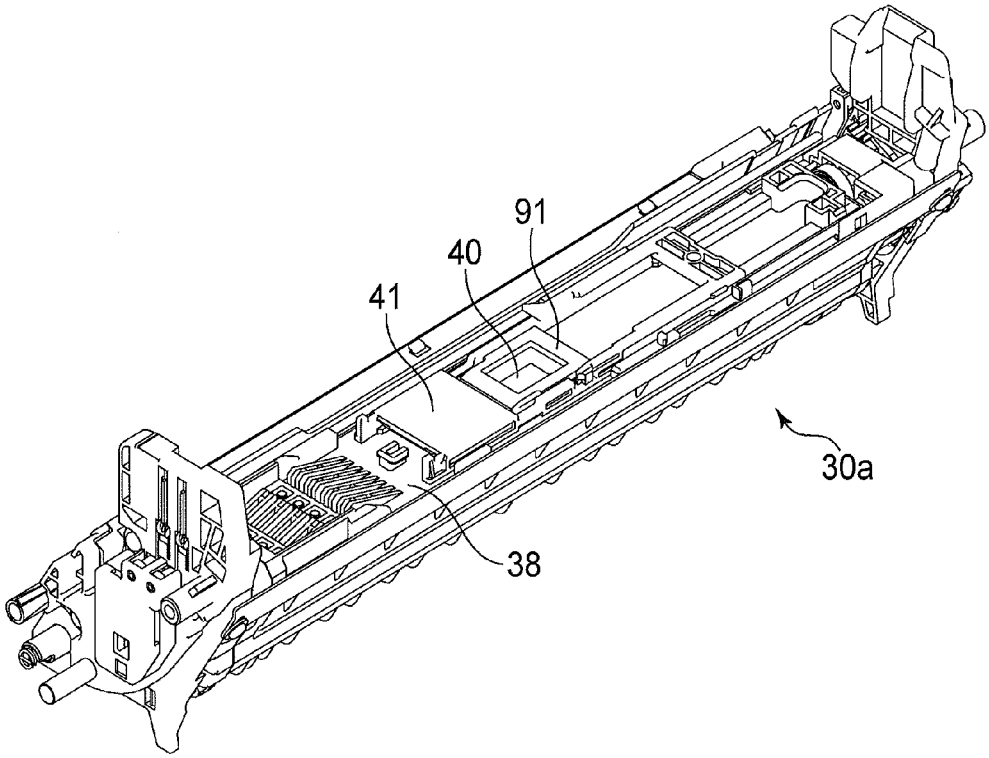
FIG. 6C is a top perspective view showing the developing device main body in a state where a receiving opening is opened.
Figure 7:
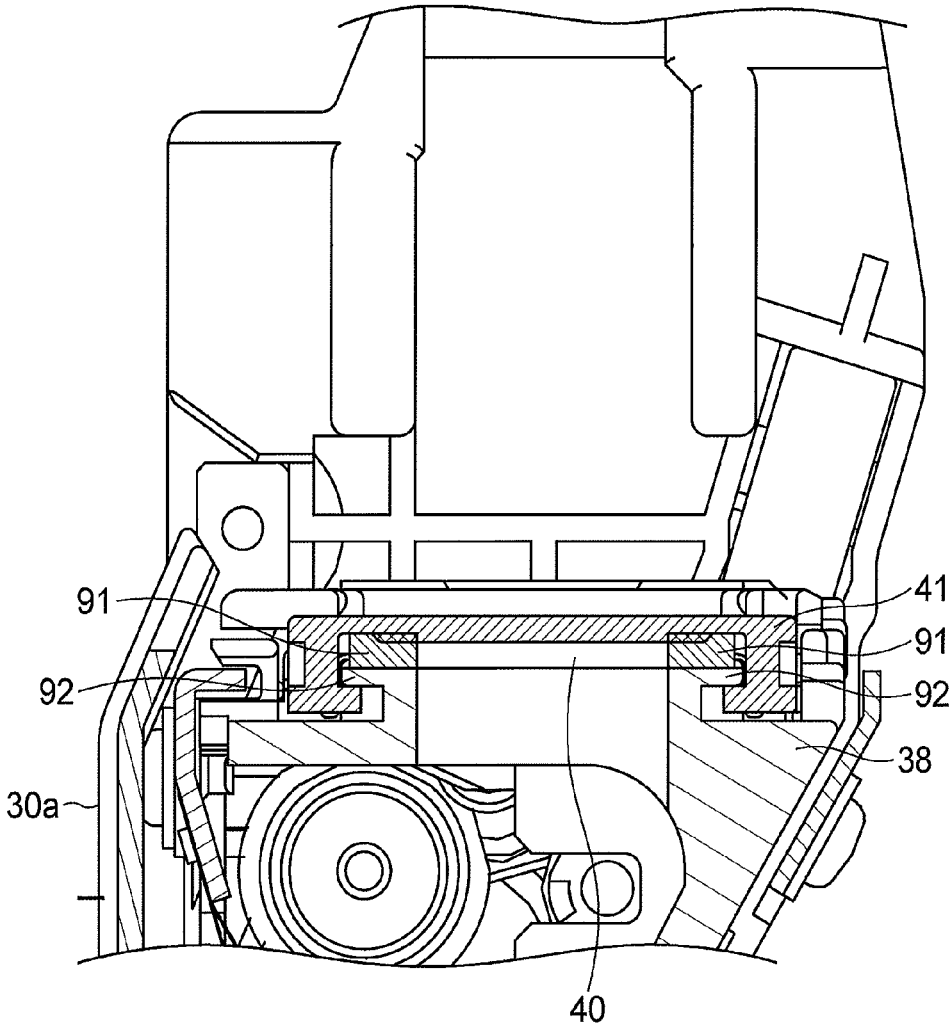
FIG. 7 is a sectional view taken along line 7-7 shown in FIG. 6B.

FIGS. 6A and 6B are top perspective views showing the developing device main body 30*a* of the developing device 30 as seen in different directions. FIG. 6C is a top perspective view showing the developing device main body 30*a* in a state where the receiving opening 40 is opened. FIG. 7 is a sectional view taken along line 7-7 shown in FIG. 6B.

In FIGS. 6A and 6B, an arrow X indicates a conveying direction of the sheet P. The same can be said to other figures. FIGS. 6A, 6B and 6C show an upper part of the frame 38 covering the developing device main body 30*a*.

As shown in FIG. 7, the developing device main body 30*a* has the receiving opening 40 and a seal member 91 provided around the receiving opening 40. The second shutter member 41 is slidably provided on the frame 38 of developing device main body 30*a* for opening and closing the receiving opening 40. The second shutter member 41 is configured to vertically sandwich rail portions 92 of the frame 38, and is slidable along the rail portions 92 without being displaced in a vertical direction. When the second shutter member 41 closes the receiving opening 40, the second shutter member 41 tightly contacts the seal member 91.

In a state shown in FIGS. 6A and 6B, the opening 40 is closed by the second shutter member 41, and the developer cartridge 60 can be mounted to the developing device main body 30*a*. In a state shown in FIG. 6C, the opening 40 is opened by the second shutter member 41, and therefore printing operation can be performed.

Figure 8A:
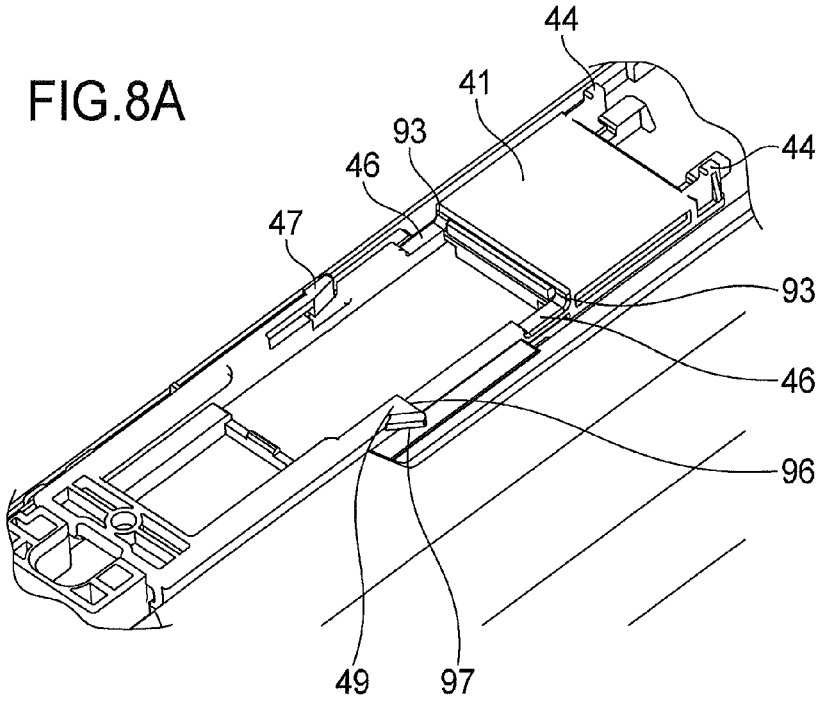
FIGS. 8A and 8B are perspective views showing a portion around the receiving opening according to the first embodiment.
Figure 8B:
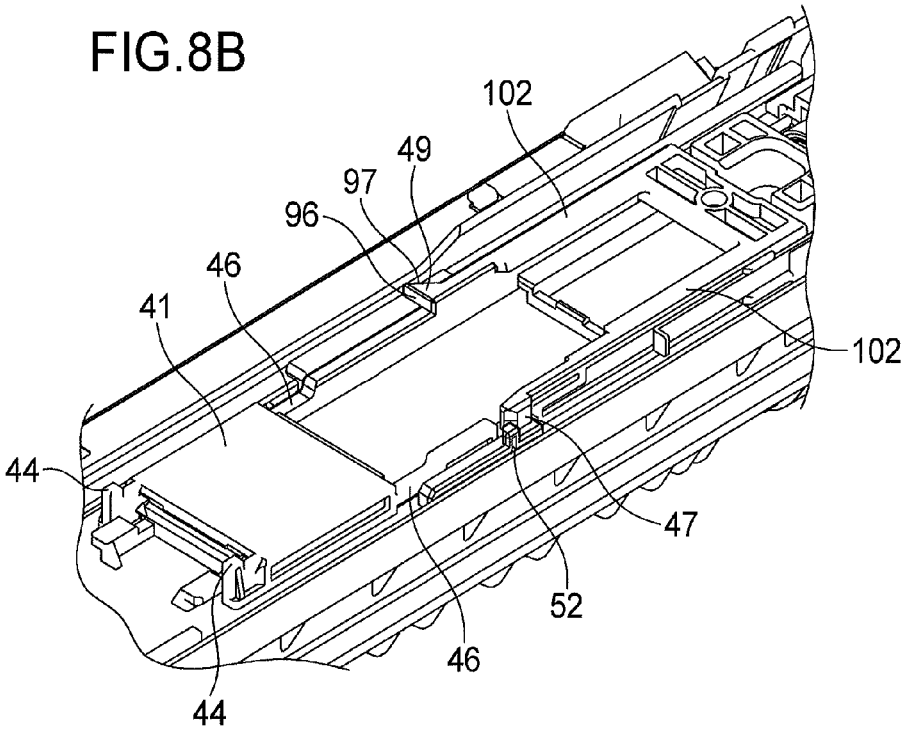

FIGS. 8A and 8B are perspective views showing a portion around the receiving opening 55 as seen in different directions.

A fourth latch member 47 is provided on the second shutter 41. A latch restricting portion 52 (i.e., a fourth stopper member) is provided on the frame 38 of the developing device main body 30*a*. The fourth latch member 47 engages the latch restricting portion 52 so as to lock a movement of the second shutter 41 from the second position (i.e., the detachable position) shown in FIG. 5A toward the first position (i.e., the printing enabling position) shown in FIG. 5B. The latch restricting portion 52 (FIG. 10A) has a function to lock a movement of the second shutter member 41.

Further, a movable amount regulating portion (not shown) is provided on the frame 38. The movable amount regulating portion restricts a movement of the second shutter member 41 from the second position (i.e., a detachable position) shown in FIG. 5A toward the third position (i.e., the fixing position) shown in FIG. 5C.

Figure 9A:
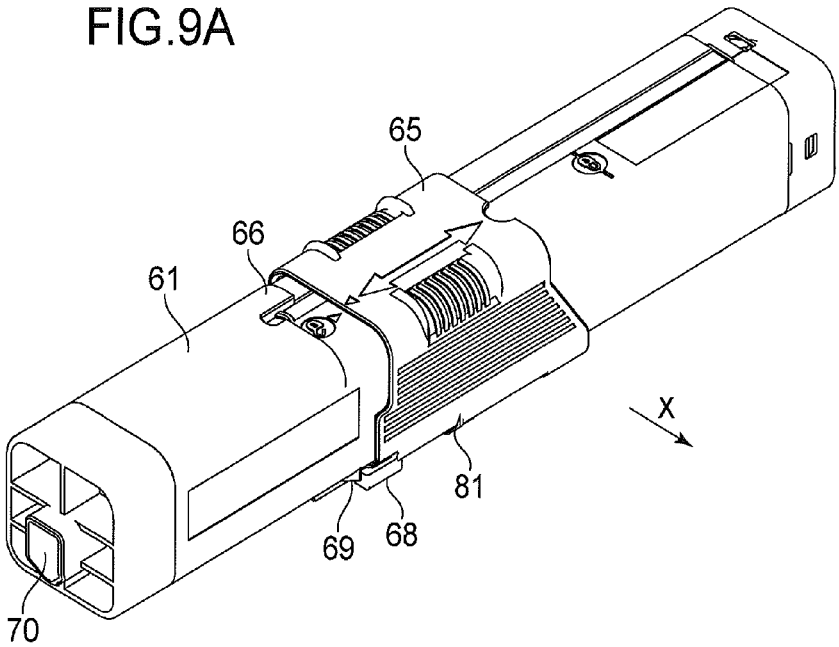
FIGS. 9A and 9B are top and bottom perspective views showing the developer cartridge according to the first embodiment.
Figure 9B:
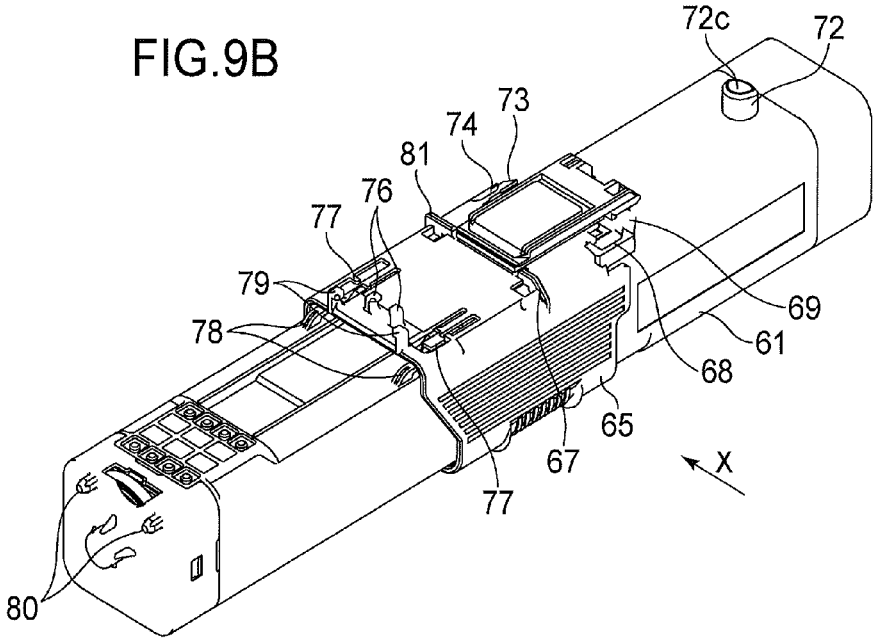

FIGS. 9A and 9B are top and bottom perspective views showing the developer cartridge 60. The first shutter member 65 is provided so as to surround the outer circumference 61 of the developer cartridge 60. The first shutter member 65 is provided on a substantial center of the developer cartridge 60 in the longitudinal direction, and is slidable in a range of the length of the developer cartridge 60. In this regard, the expression "the first shutter member 65 is provided on a substantial center of the developer cartridge 60" indicates that a center of the first shutter member 65 is located in a range of ±20 mm with respect to a center of the developer cartridge 60. The first shutter member 65 has a size such that a user can hold the first shutter member 65 in one hand. For example, the first shutter member 65 has a length longer than or equal to 50 mm (more preferably, in a range from 50 mm to 100 mm). Further, the first shutter member 65 has an operating portion 65*a*. The operating portion 65*a* is operated by the user to move (slide) the first shutter member 65.

Figure 10A:
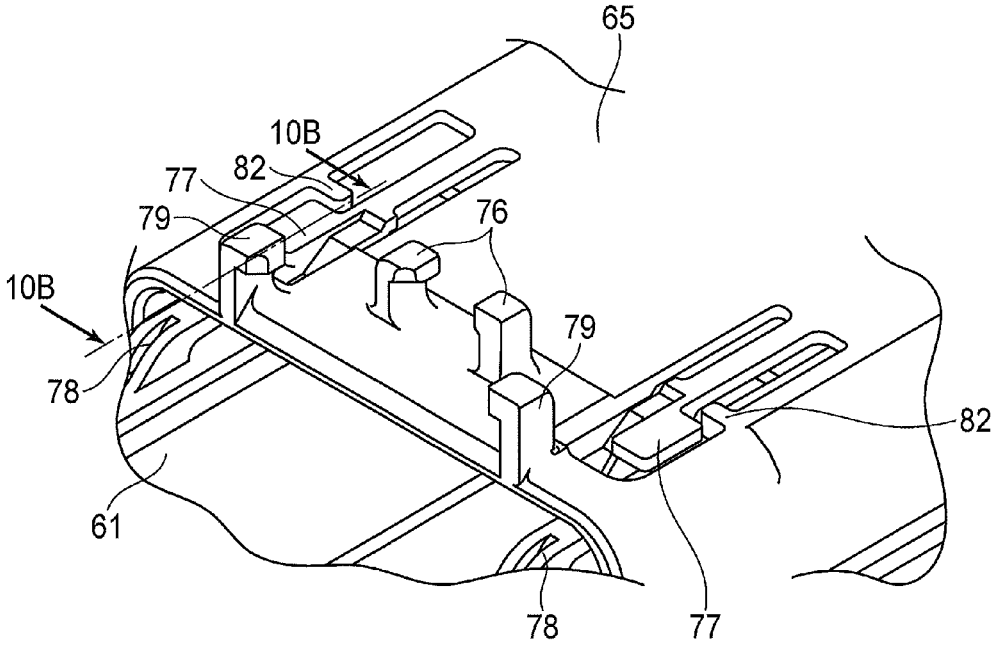
FIG. 10A is an enlarged view showing a part of the first shutter member according to the first embodiment.
Figure 10B:
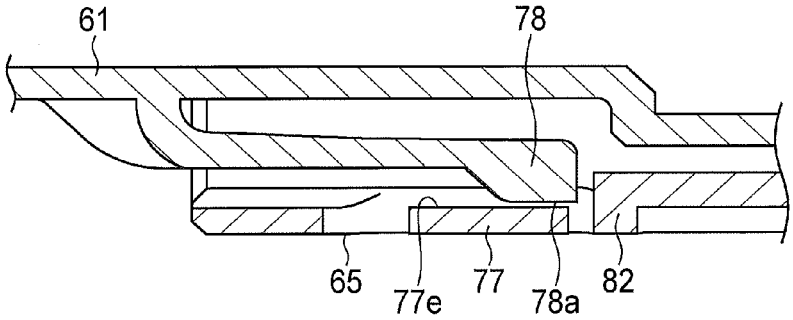
FIG. 10B is a sectional view taken along line 10B-10B in FIG. 10A.
Figure 10C:
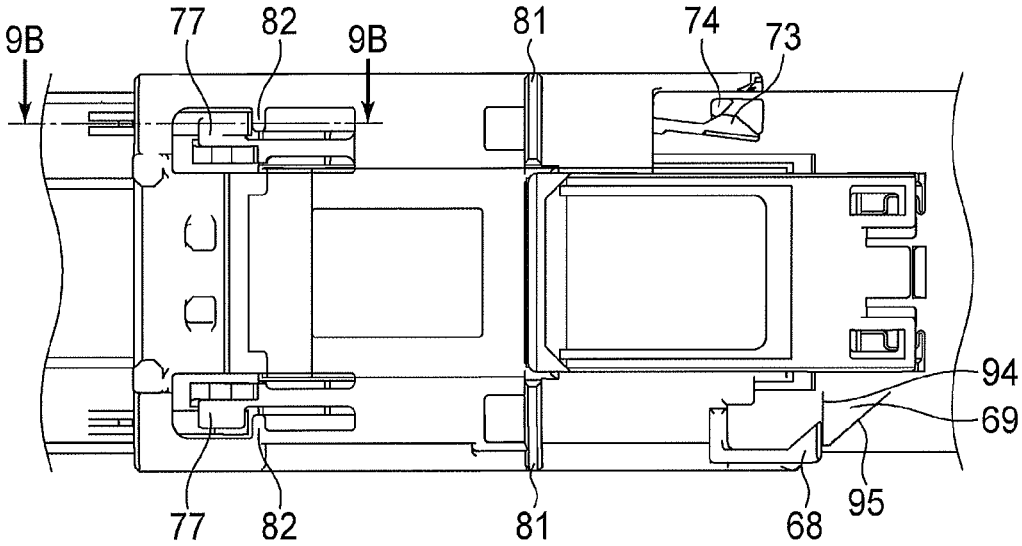
FIG. 10C is a bottom view of the developer cartridge according to the first embodiment.

FIG. 10A is an enlarged perspective view of a part of the first shutter member 65. FIG. 10B is a sectional view taken along line 10B-10B in FIG. 10A. FIG. 10C is a bottom view of the developer cartridge 60 having the first shutter member 65.

As shown in FIGS. 10A and 10C, a latch restricting rib 82 (i.e., a first stopper member) is provided on the first shutter member 65. A first latch member 78 is provided on the outer circumference 61 of the developer cartridge 60. The latch restricting rib 82 engages the first latch member 78 so as to lock a movement of the first shutter member 65.

Referring back to FIG. 9B, protrusions 80 are provided on an end (i.e., on the first position side) of the storage portion 62 of the developer cartridge 60. The protrusions 80 extend in the longitudinal direction of the developer cartridge 60. As shown in FIG. 6A, mounting holes 42 are formed on the developing device main body 30*a*. The mounting holes 42 are located so that the protrusions 80 of the developer cartridge 60 are inserted into the mounting holes 42.

As shown in FIG. 9B, a post 72 is provided on the storage portion 62 of the developer cartridge 60. As shown in FIG. 6B, a U-shaped groove portion 48 is provided on the frame 38 of the developing device main body 30*a*. The U-shaped groove portion 48 is located so that the post 72 of the developer cartridge 60 is inserted into the U-shaped groove portion 48. The post 72 has a chamfered surface 72C on a side facing away from the protrusions 80.

As shown in FIG. 9A, a convex portion 70 (i.e., a to-be-guided portion) is provided on the end portion of the storage portion 62 of the developer cartridge 60 opposite to the protrusions 80. As shown in FIG. 6B, a guide ribs (i.e., a guide portion) 54 are provided on the developing device main body 30*a*. The guide ribs 54 are provided so as to guide the convex portion 70 when the developer cartridge 60 is mounted to the developing device main body 30*a*.

As shown in FIG. 9B, a rib 81 is provided on the first shutter member 65. As shown in FIG. 8A, groove portions 46 are provided on the second shutter member 41. The groove portions 46 are located so as to correspond to the rib 81 of the developer cartridge 60. The groove portions 46 have rib-receiving surfaces 93 (on the first position side) that contact the rib 81 of the developer cartridge 60.

As shown in FIG. 10A, a third latch member 77 is provided on the first shutter member 65. When the developer cartridge 60 is mounted to the developing device main body 30*a*, the third latch member 77 is pushed by a convex portion 44 (i.e., a first releasing portion) of the second shutter member 41 (FIG. 8B), and is resiliently deflected. Further, as the third latch member 77 is resiliently deflected, a contact portion 77*e* of the third latch member 77 pushes a contact portion 78*a* of the first latch member 78 (FIG. 10B). Therefore, the first latch member 78 is resiliently deflected, and is released from the latch restricting rib 82, with the result that the first shutter member 65 becomes movable from the second position (i.e., the detachable position) toward the first position (i.e., the printing enabling position).

Further, as shown in FIGS. 9B and 10C, a fifth latch member 73 is provided on the first shutter member 65. A convex portion 74 (i.e., a second releasing portion) is provided on the outer circumference 61 of the developer cartridge 60. The convex portion 74 has a function to push the fifth latch member 73 so as to allow the first shutter member 65 to move.

When the developer cartridge 60 is mounted to the developing device main body 30*a*, and when the first shutter member 65 starts being moved toward the first position, the fifth latch member 73 is pushed by the convex portion 74 of the outer circumference 61 of the developer cartridge 60, and is resiliently deflected. As the fifth latch member 73 is resiliently deflected, the fifth latch member 73 pushes the fourth latch member 47 (FIG. 8B) of the second shutter member 41. Therefore, the fourth latch member 47 is resiliently deflected, and is released from the latch restricting portion 52, with the result that the second shutter member 41 becomes movable toward the first position.

Figure 11A:
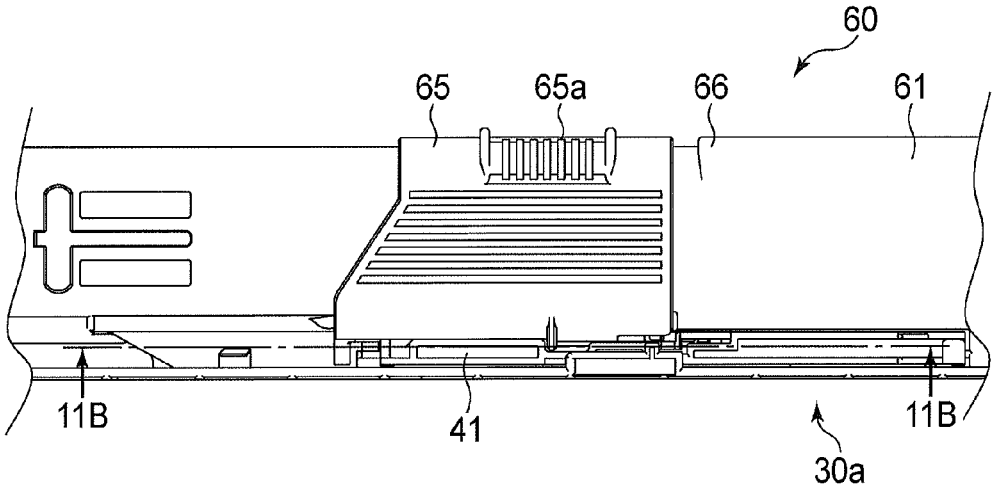
FIG. 11A is a side view showing the first shutter member and the second shutter member according to the first embodiment.
Figure 11B:
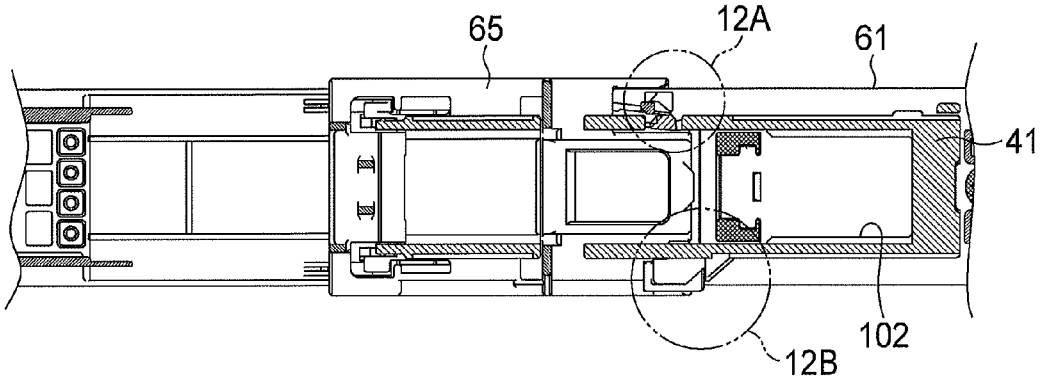
FIG. 11B is a sectional view taken along line 8B-8B in FIG. 11A.
Figure 12A:
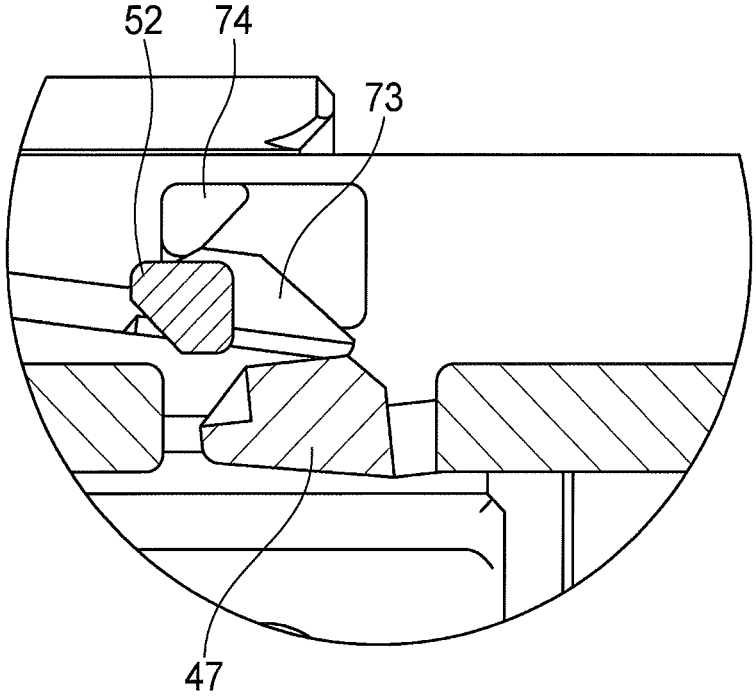
FIGS. 12A and 12B are enlarged partial views respectively showing parts encircled by circles 12A and 12B in FIG. 11B.
Figure 12B:
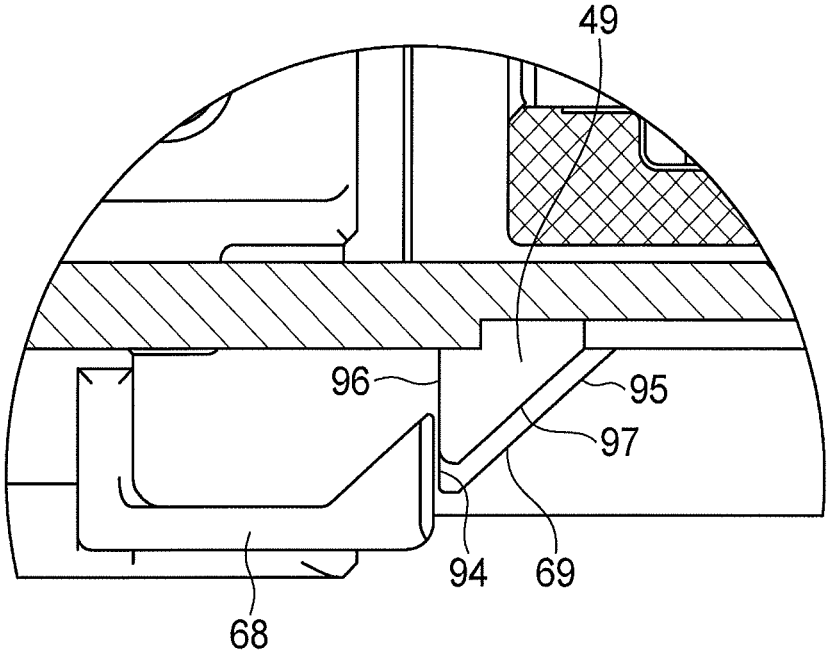

FIG. 11A is a side view showing the first shutter member 65 and the second shutter member 41 in a state where the first shutter member 65 is in the second position (i.e., the detachable position) shown in FIG. 5A. FIG. 11B is a sectional view taken along line 11B-11B in FIG. 11A. FIGS. 12A and 12B are enlarged views respectively showing parts encircled by circles 12A and 12B in FIG. 11B.

In this state, as shown in FIG. 11A, the first shutter member 65 is in the substantial center (i.e., the second position) of the storage portion 62, and the developer cartridge 60 is detachable from the developing device main body 30*a*. Further, as shown in FIG. 11B, the supplying opening 64 of the storage portion 62 is closed by the first shutter member 65, the receiving opening 40 of the developing device main body 40*a* is closed by the second shutter member 41.

As shown in FIG. 12A, the fifth latch member 73 of the first shutter member 65 is pushed by the convex portion 74 of the outer circumference 61 of the developer cartridge 60, and pushes the fourth latch member 47 of the developing device main body 30*a*, so that the first and second shutter members 65 and 41 become movable toward the first position (i.e., the printing enabling position) as described above.

As shown in FIG. 12B, a stopper member 69 is provided on the outer circumference 61 of the developer cartridge 60. The stopper member 69 has a second contact surface 94 and a second inclined surface 95. A stopper member 49 (i.e., a second stopper member) is provided on the second shutter member 41. The stopper member 49 has a first contact surface 96 and a first inclined surface 97. In this state, the stopper member 69 and the stopper member 49 are aligned with each other. Further, a second latch member 68 is provided on the first shutter member 65. The second latch member 68 contacts (or is slightly apart from) the first contact surface 96 of the stopper member 49 and the second contact surface 94 of the stopper member 69.

Figure 13A:
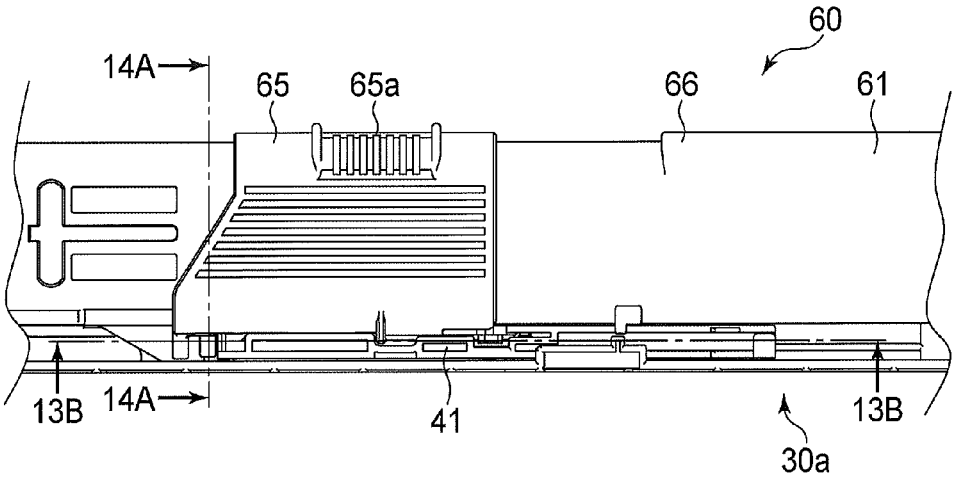
FIG. 13A is a side view showing the first shutter member and the second shutter member according to the first embodiment.
Figure 13B:
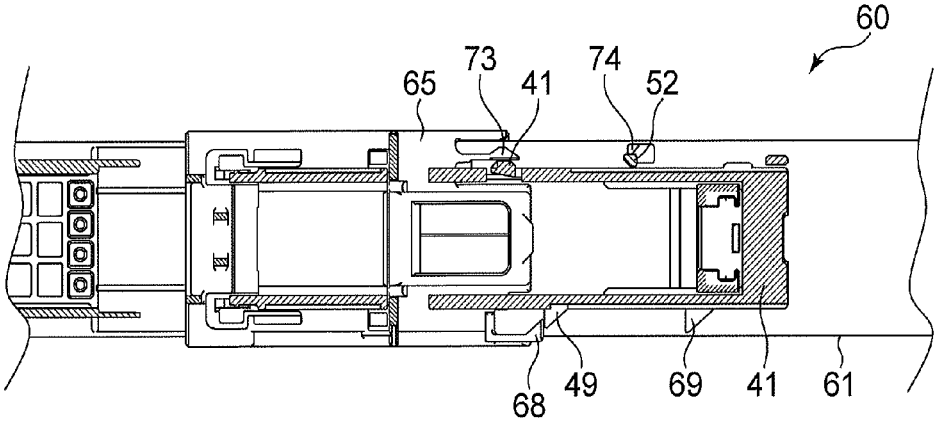
FIG. 13B is a sectional view taken along line 13B-13B in FIG. 13A.
Figure 14A:
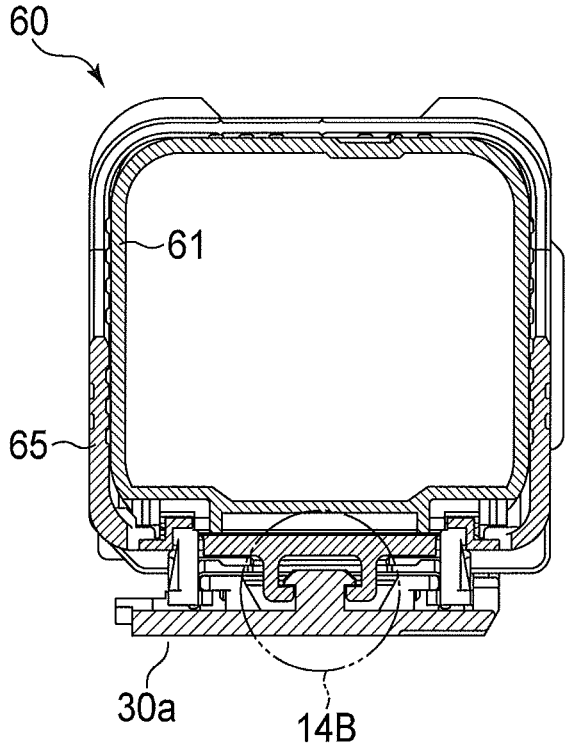
FIG. 14A is a sectional view taken along line 14A-14A in FIG. 13A.
Figure 14B:
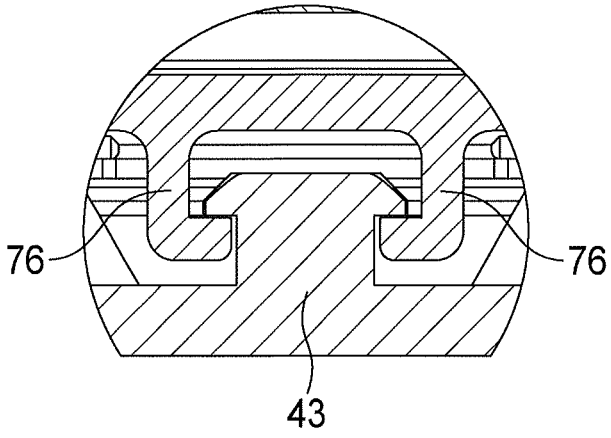
FIG. 14B is an enlarged view showing a part encircled by a circle 14B in FIG. 14A.

FIG. 13A is a side view showing the first shutter member 65 and the second shutter member 41 in a state where the first shutter member 65 is in the first position (i.e., the printing enabling position) shown in FIG. 5B. FIG. 13B is a sectional view taken along line 13B-13B in FIG. 13A. FIG. 14A is a sectional view taken along line 14A-14A in FIG. 13A. FIG. 14B is an enlarged view showing a part encircled by a circle 14B in FIG. 14A.

In this state, the developer cartridge 60 is fixed to the developing device main body 30*a*, and the supplying opening 64 and the receiving opening 40 are both opened. Accordingly, the developer cartridge 60 is able to supply the developer to the developing device main body 30*a*, and therefore the image forming apparatus is able to perform printing.

As shown in FIG. 14B, a fixing portion 43 as a third engaging portion is provided on the developing device main body 30*a*. Further, fixing portions 76 (i.e., a first engaging portion) are provided on the first shutter member 65. In this state, the fixing portion 43 engages the fixing portions 76, so that the developer cartridge 60 is fixed to the developing device main body 30*a*.

Further, as shown in FIG. 13B, the second latch member 68 of the first shutter member 65 contacts the stopper member 49 of the second shutter member 41. The stopper member 49 has a function to restrict the movement of the first shutter member 65 toward the third position as the fixing position (i.e., in the direction S2 shown in FIG. 5A).

Figure 15A:
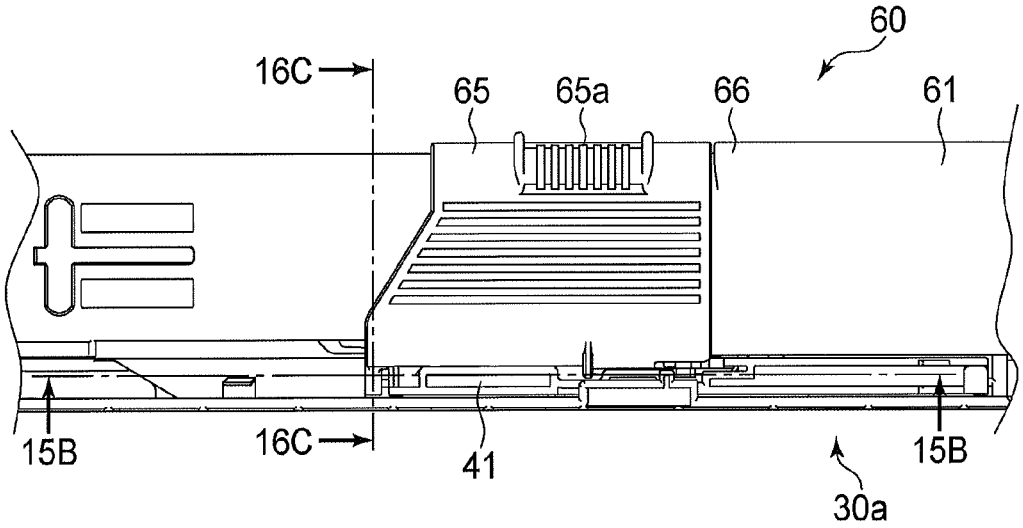
FIG. 15A is a side view showing the first shutter member and the second shutter member according to the first embodiment.
Figure 15B:
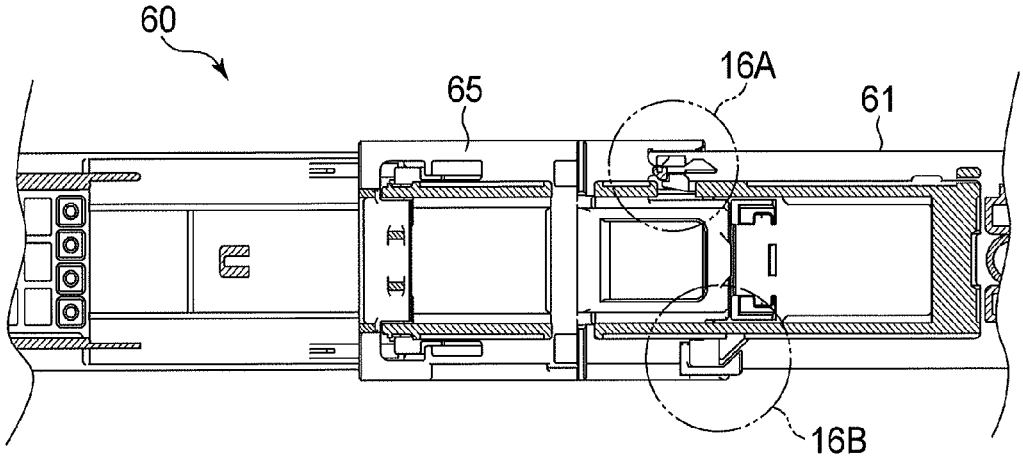
FIG. 15B is a sectional view taken along line 15B-15B in FIG. 15A.
Figure 16A:
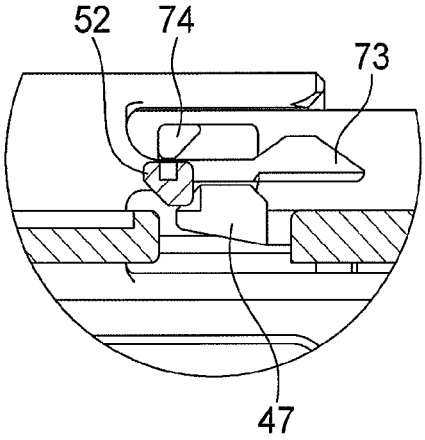
FIGS. 16A and 16B are enlarged views respectively showing parts indicated by circles 16A and 16B in FIG. 15B.
Figure 16B:
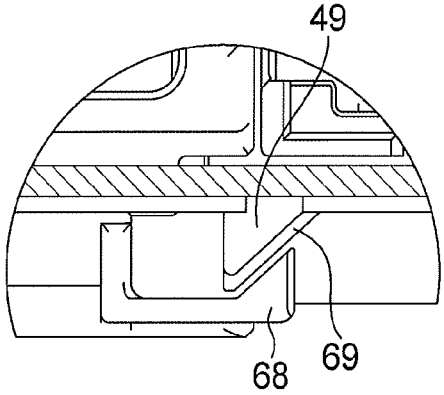
Figure 16C:
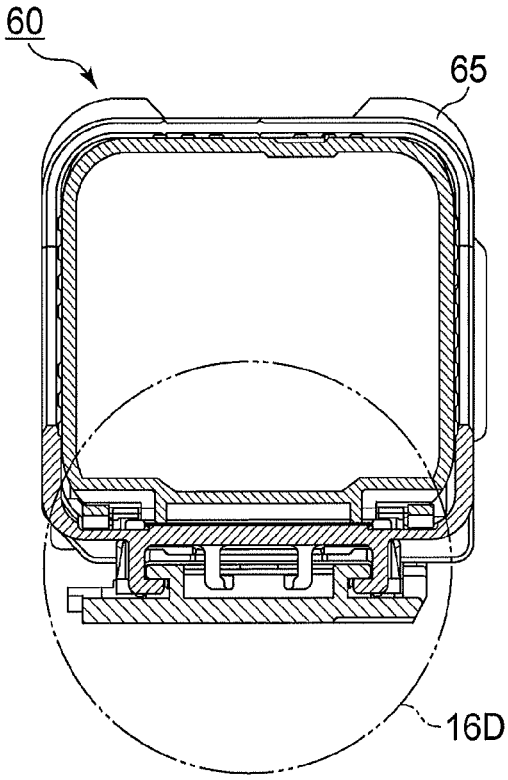
FIG. 16C is a sectional view taken along line 16C-16C in FIG. 15A.
Figure 16D:
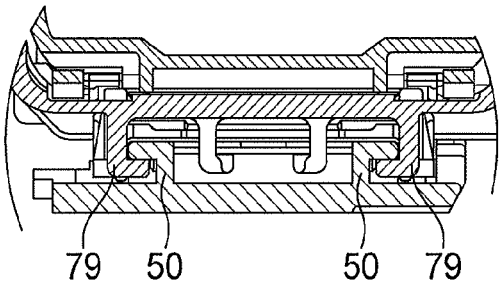
FIG. 16D is an enlarged view showing a part encircled by a circle 16D in FIG. 16C.

FIG. 15A is a side view showing the first shutter member 65 and the second shutter member 41 in a state where the first shutter member 65 is in the third position (i.e., the fixing position) shown in FIG. 5C. FIG. 15B is a sectional view taken along line 15B-15B in FIG. 15A. FIGS. 16A and 16B are enlarged views respectively showing parts encircled by circles 16A and 16B in FIG. 15B. FIG. 16C is a sectional view taken along line 16C-16C in FIG. 15A. FIG. 16D is an enlarged view showing a portion encircled by a circle 16D in FIG. 16C.

In this state, the developer cartridge 60 is fixed to the developing device main body 30*a*, and the supplying opening 64 and the receiving opening 40 are both closed.

As shown in FIG. 16A, the fifth latch member 73 of the first shutter member 65 is not pushed by the convex portion 74 of the developer cartridge 60, and the fifth latch member 73 is not deflected. Therefore, the fourth latch member 47 of the second shutter member 41 is not pushed by the fifth latch member 73, and the fourth latch member 47 is not deflected.

As shown in FIG. 16B, a state where the second latch member 68 engages the stopper member 69 is obtained by largely deflecting the second latch member 68 so as to pass over the stopper members 49 and 69 using a tool (for example, a flathead screw driver or an exclusive tool), and by moving the first shutter member 65 in the direction S2 (FIG. 5A).

As shown in FIG. 16D, fixing portions 50 (i.e., a fourth engaging portion) is provided on the developing device main body 30*a*. Fixing portions 79 (i.e., a second engaging portion) are provided on the first shutter member 65. In this state, the fixing portions 50 engage the fixing portions 79, so that the developer cartridge 60 is fixed to the developing device main body 30*a*.

Further, as shown in FIG. 15A, the first shutter member 65 contacts (or is slightly apart from) a third stopper member 66 provided on the outer circumference 61 of the developer cartridge 60.

<Operation of Image Forming Apparatus>

An entire operation of the image forming apparatus will be described with reference to FIGS. 1 and 2.

When the image forming apparatus starts a printing operation, the hopping roller 13 rotates to feed the sheet P from the feeding tray 12 mounted to the frame 11. The sheet P is conveyed by the conveying rollers 15 along the feeding guide 14, and reaches the detecting unit 16. The detecting unit 16 detects a thickness of the sheet P. When the detecting unit 16 detects the arrival of the sheet P, the developing devices 30 (30K, 30Y, 30M and 30C) start operations for image formation.

In each developing device 30, the developer T (FIG. 2) supplied from the developer cartridge 60 is supplied to the developing roller 35 by the supplying roller 36. The developer supplied to the developing roller 35 is formed into a layer whose thickness is regulated by the developing blade 37. The developer is then supplied to the photosensitive drum 31 so as to develop a latent image formed by the exposure unit 25, and a developer image (i.e., a visualized image) is formed on the photosensitive drum 31.

The sheet P is conveyed by the transfer belt unit 18 to a position where the sheet P is nipped by the photosensitive drum 31 and the transfer roller 19, and the developer image is transferred to the sheet P by action of the transfer roller 19. A residual developer remaining on the surface of the photosensitive drum 31 is scraped off by the cleaning blade 33, and the scraped-off developer is conveyed to a waste developer collecting portion (not shown).

After the cleaning blade 33 cleans the surface of the photosensitive drum 31, an electricity removal device 32 exposes the surface of the photosensitive drum 31 so as to eliminate an electric potential difference between a portion where the latent image has been formed and other portions. Then, the charging roller 32 uniformly charges the surface of the photosensitive drum 31.

As the sheet P is conveyed through the developing devices 30K, 30Y, 30M and 30C, the developer images of the respective colors are transferred to the sheet P.

The sheet P to which the developer image is transferred is conveyed to the fixing unit 20. The fixing unit 20 applies heat and pressure to the sheet P so as to fix the developer image to the sheet P. The sheet P to which the developer image is fixed is ejected by the ejection rollers 21 and 22 to the stacker 23.

<Operation of Developer Cartridge and Developing Device Main Body>

Figure 17:
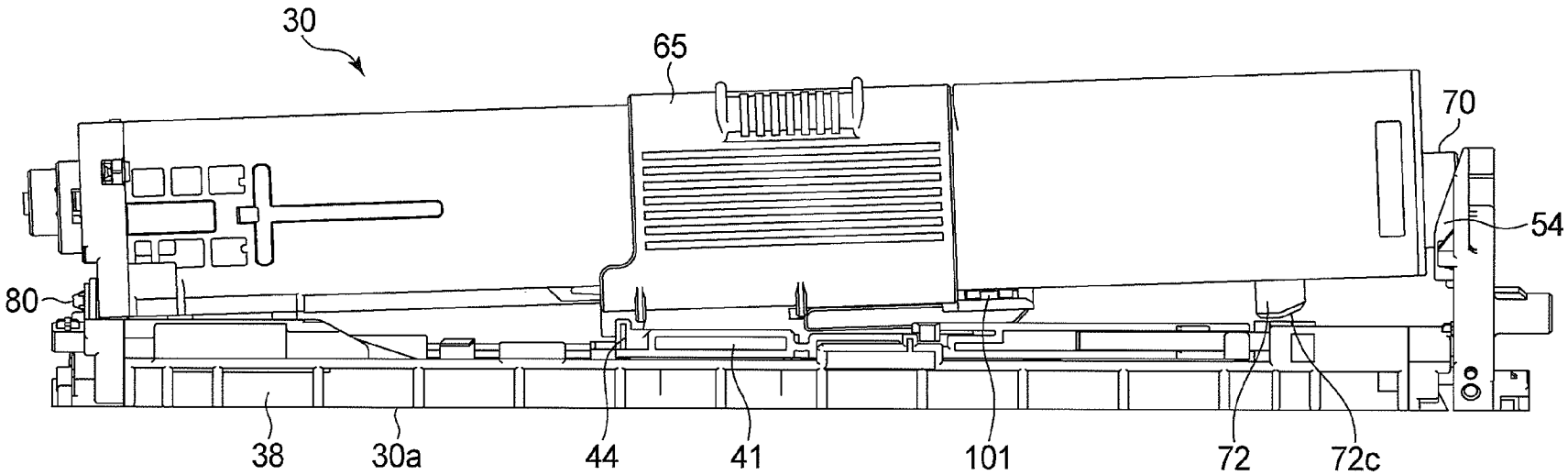
FIG. 17 is a side view for illustrating a mounting operation of the developer cartridge to the developing device main body according to the first embodiment.

FIG. 17 is a side view showing an operation for mounting the developer cartridge 60 to the developing device main body 30*a*.

The protrusions 80 provided on the end portion (i.e., on the first position side) of the storage portion 62 of the developer cartridge 60 are inserted into the mounting holes 42 (FIG. 6A) of the frame 38 of the developing device main body 30*a*. The convex portion 70 provided on the other end portion (i.e., the third position side) of the storage portion 62 of the developer cartridge 60 is guided by the guiding portion 54 of the frame 38 of the developing device main body 30*a*, so that the developer cartridge 60 is mounted to the developing device main body 30*a* in an inclined manner.

In this state, the post 72 of the developer cartridge 60 is inserted into the U-shaped groove 48 (FIG. 6B) of the frame 38. The post 72 has the chamfered surface 72C on the side facing away from the protrusions 80. When the developer cartridge 60 is mounted to the developing device main body 30*a* in an inclined manner, the post 72 does not interfere with an entrance of the U-shaped groove 48 since the post 72 has the chamfered surface 72C. Therefore, the developer cartridge 60 can be smoothly mounted to the developing device main body 30*a*.

As described above, the mounting holes 42 and the protrusions 80 are located on the first position side, and the convex portion 70 and the guiding portion 54 are located on the third position side. Therefore, the user can move the first shutter member 65 from the second position (i.e., the detachable position) to the first position (i.e., the printing enabling position) by moving the first shutter member 65 so that the protrusions 80 abut against the mounting holes 42. Accordingly, the developing cartridge 60 is unlikely to move upward from the developing device main body 30*a* while the first shutter member 65 moves. Thus, the first shutter member 65 can move smoothly and evenly.

In contrast, if the protrusions 80 and the mounting holes 42 are provided on the third end side, and the convex portion 70 and the guiding portion 54 are provided on the first end side, the convex portion 70 abuts against the guiding portion 54 when the first shutter member 65 moves from the second position to the first position. However, since relative positions of the convex portion 70 and the guiding portion 54 in the vertical direction are not fixed, the developer cartridge 60 may move upward while the first shutter member 65 is moving (i.e., the first shutter member 65 may not smoothly move).

For this reason, in this embodiment, a positional relationship between the first position, the second position and the third position, the mounting holes 42, the protrusions 80, the convex portion 70 and the guiding portion 54 is determined as described above.

Figure 18A:
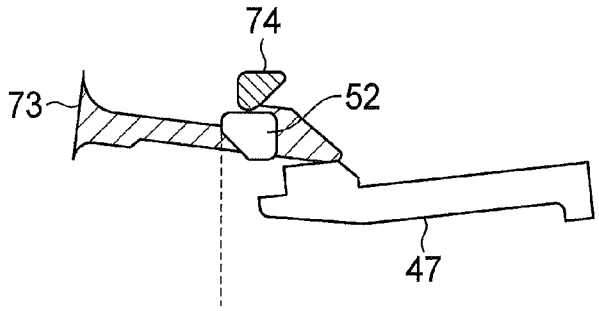
FIGS. 18A, 18B and 18C are schematic views showing operations of a fourth latch member, a fifth latch member, a convex portion and a latch restricting portion according to the first embodiment.
Figure 18B:
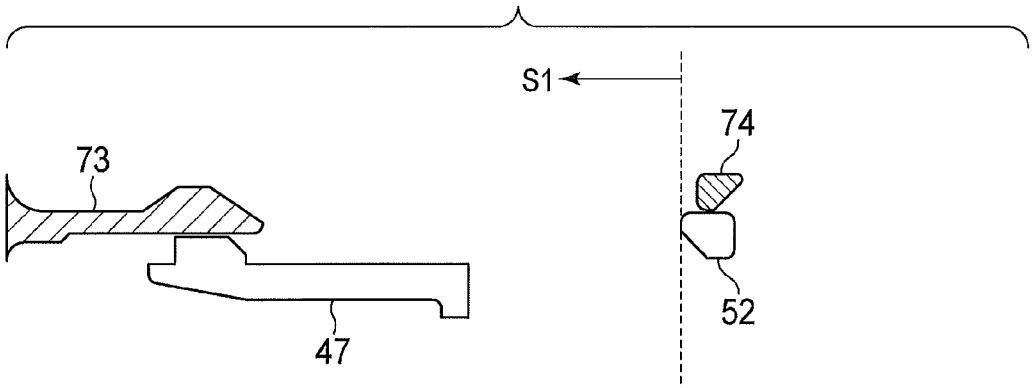
Figure 18C:
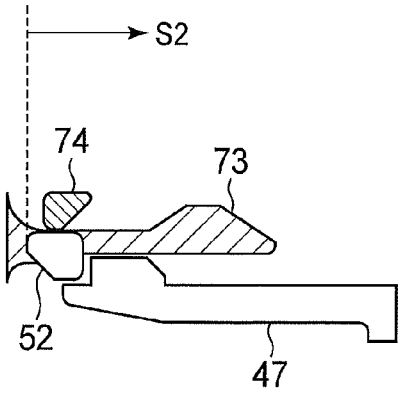

FIGS. 18A, 18B and 18C are schematic views showing operations of the fourth latch member 47 and the fifth latch member 73, the convex portion 74 and the latch restricting portion 52. FIGS. 18A, 18B and 18C respectively correspond to the second position (i.e., the detachable position), the first position (i.e., the printing enabling position) and the third position (i.e., the fixing position).

Figure 19A:
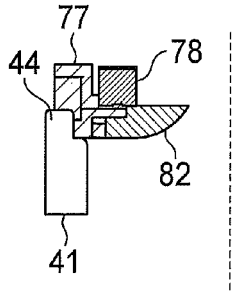
FIGS. 19A, 19B, 19C, 19D, 19E and 19F are schematic views showing operations of a first latch member, a third latch member, a latch restricting rib and a convex portion according to the first embodiment.
Figure 19B:
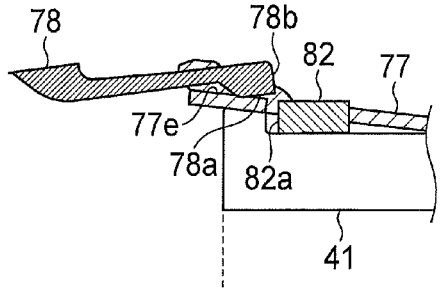
Figure 19C:
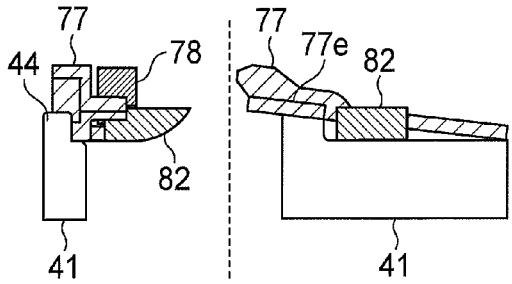
Figure 19D:
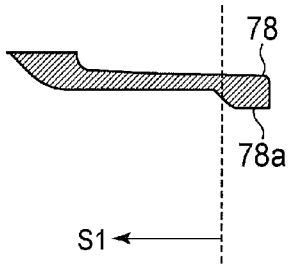

FIGS. 19A through 19F are schematic views showing operations of the first latch member 78, the third latch member 77, the latch restricting rib 82 and the convex portion 44. FIGS. 19A and 19B correspond to the second position, FIGS. 19C and 19D correspond to the first position, and FIGS. 19E and 19F correspond to the third position.

Figure 20A:
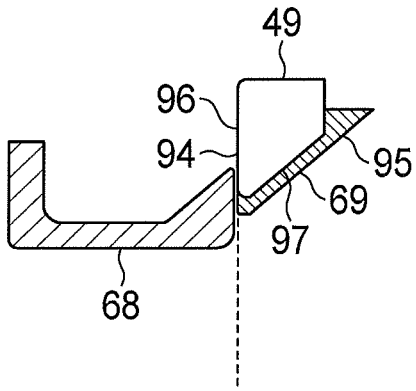
FIGS. 20A, 20B and 20C are schematic views showing operations of a second latch member and stopper members according to the first embodiment.
Figure 20B:
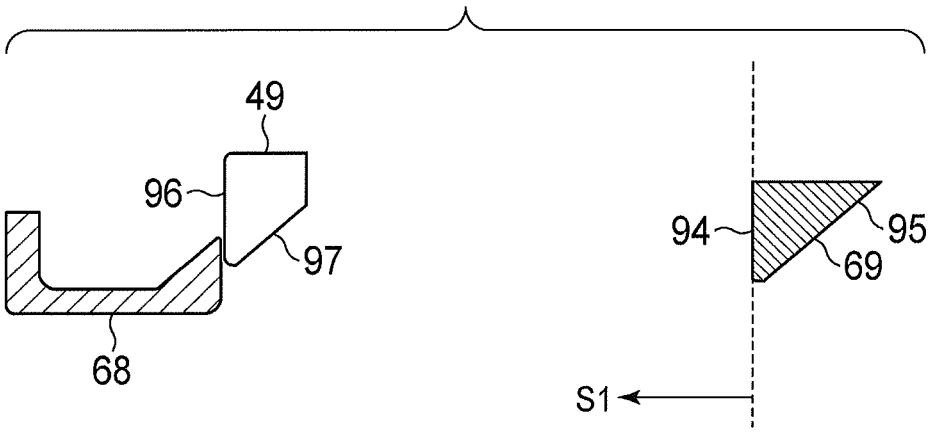
Figure 20C:
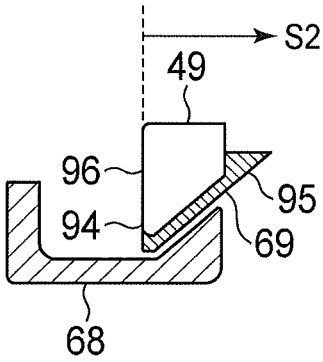

FIGS. 20A through 20C are schematic views showing operations of the second latch member 68, the stopper member 49 and the stopper member 69. FIGS. 20A, 20B and 20C respectively correspond to the second position, the first position and the third position.

As shown in FIGS. 19A and 19B, when the developer cartridge 60 is mounted to the developing device main body 30*a*, the convex portion 44 of the second shutter member 41 pushes the third latch member 77 of the first shutter member 65, and the third latch member 77 pushes the first latch member 78 to release the first latch member 78 from the latch restricting rib 82. Therefore, the first shutter member 65 becomes movable toward the first position (i.e., the printing enabling position). Further, as shown in FIG. 18A, when the first shutter member 65 starts moving toward the first position, the fifth latch member 73 of the first shutter member 65 is pushed by the convex portion 74 of the developer cartridge 60, and pushes the fourth latch member 47 of the developing device main body 30*a* to release the fourth latch member 47 from the latch restricting portion 52 of the developing device main body 30*a*. Therefore, the second shutter member 41 becomes movable toward the first position (i.e., the printing enabling position).

Nest, description will be made to an operation for switching from a state where the developer cartridge 60 is detachable from the developing device main body 30*a* (FIG. 5A) to a state where printing can be performed (FIG. 5B).

An end surface of the groove portion 46 (FIG. 8B) of the second shutter member 41 contacts a side surface of the rib 81 (FIG. 9B) of the first shutter member 65. Therefore, when the first shutter member 65 moves in the direction S1 (FIG. 5A) toward the first position, the second shutter member 41 moves in the same direction together with the first shutter member 65.

When the first shutter member 65 starts moving toward the first position together with the second shutter member 41, ribs 102 (FIG. 8B) provided on the second shutter member 41 slidably engage groove portions 101 (FIG. 17) provided on the outer circumference 61 of the developer cartridge 60. This prevents the developer cartridge 60 from moving in a detaching direction with respect to the developing device main body 30*a*.

As a result of the movement of the first shutter member 65 and the second shutter member 41, the supplying opening 64 of the developer cartridge 60 and the receiving opening 40 of the developing device main body 30*a* (which are aligned with each other) are both opened. That is, the first shutter member 65 reaches the first position (FIG. 5B).

A movable amount of the second shutter member 41 is regulated by the movable amount regulating portion, and therefore the first shutter member 65 and the second shutter member 41 are stopped. The fixing portion 43 (FIG. 14B) of the developing device main body 30*a* engage the fixing portions 76 of the developer cartridge 60, with the result that the developer cartridge 60 is fixed to the developing device main body 30*a*. With such an operation, the image forming apparatus becomes able to perform printing.

Since the first shutter member 65 is provided at the substantial center of the developer cartridge 60, it becomes possible to visually observe the movement of the first shutter member 65. Further, the first shutter member 65 has the operating portion 65*a*, and has the size (in a range from 50 mm to 100 mm) such that a user can handle the first shutter member 65 in one hand. Therefore, the user can easily apply a force to the developer cartridge 60 in mounting or detaching operation, and can easily handle the developer cartridge 60 in one hand.

Next, description will be made to an operation for detaching the developer cartridge 60 from the developing device main body 30*a* with reference to FIGS. 12A and 12B. When the first shutter member 65 moves in the direction S2 (FIG. 5A) from the first position (i.e., the printing enabling position) toward the second position (i.e., the detachable position), the end surface of the second latch member 68 of the first shutter member 65 pushes the contact surface 96 of the stopper member 49 of the second shutter member 41, and the second shutter member 41 moves together with the first shutter member 65. Then, the second latch member 68 of the first shutter member 65 contacts the contact portion 94 of the stopper member 69 of the developer cartridge 60 as shown in FIG. 12B. Therefore, the first shutter member 65 and the second shutter member 41 are both stopped.

When the developer cartridge 60 is detached from the developing device main body 30*a*, the convex portion 74 of the developer cartridge 60 departs from the fifth latch member 73, and the fourth latch member 47 of the developing device main body 30*a* engages the latch restricting portion 52, with the result that the second shutter member 41 is locked. Further, the convex portion 44 of the second shutter member 41 departs from the third latch member 77, and the first latch member 78 engages the latch restricting rib 82, with the result that the shutter member 65 is locked. Other steps are performed in a reverse order with respect to the mounting operation of the developer cartridge 60.

In this regard, in a state where the developer cartridge 60 is not mounted to the developing device main body 30*a*, the first shutter member 65 does not move even when a force is applied to the first shutter member 65. This is because the convex portion 44 of the second shutter member 41 does not push the third latch member 77 (i.e., the third latch member 77 does not push the first latch member 78), and therefore the first shutter member 65 is locked by engagement between a contact portion 78*b* (FIG. 19B) of the first latch member 78 and a contact portion 82*a* (FIG. 19B) of the latch restricting rib 82.

Next, description will be made to an operation for switching to a state where the supplying opening 64 and the receiving opening 40 are both closed, and the developer cartridge 60 is fixed to the developing device main body 30*a* (FIG. 5C).

As shown in FIG. 20C, by largely deflecting the second latch member 68 of the first shutter member 65 so as to pass over the stopper members 49 and 69 using the flathead driver or exclusive tool, the first shutter member 65 becomes movable in the direction S2. After the first shutter member 65 moves in the direction S2, the first shutter member 65 stops by contacting the third stopper member 66 (FIG. 15). In this state, the fixing portions 79 of the developer cartridge 60 engage the fixing portion 50 of the developing device main body 30*a* as shown in FIG. 16D, and therefore the developer cartridge 60 is fixed to the developing device main body 30*a*.

The post 72 (FIG. 9B) of the outer circumference 61 of the developer cartridge 60 contacts the U-shaped groove 48 (FIG. 6B) of the developing device main body 30*a*, and therefore a movement of the developer cartridge 60 in the direction S2 (FIG. 5A) is restricted.

The end surface of the groove portion 46 (FIG. 8B) of the second shutter member 41 does not contact the rib 81 of the first shutter member 65 while the first shutter member 65 moves from the second position (i.e., the detachable position) to the third position (i.e., the fixing position) in the direction S2. Therefore, the second shutter member 41 does not move in the direction S2, but the first shutter member 65 moves is the direction S2.

As only the first shutter member 65 moves, the fifth latch member 73 (FIG. 18C) of the first shutter member 65 moves. In this state, the fifth larch member 73 is not pushed by the convex portion 74 of the developer cartridge 60, and the fifth latch member 73 is not deflected. Therefore, the fourth latch member 47 of the second shutter member 41 is not pushed by the fifth latch member 73, and the fourth latch member 47 is not deflected.

Further, as only the first shutter member 65 moves, the third latch member 77 (FIGS. 19E and 19F) of the first shutter member 65 moves. In this state, the third latch member 77 is not pushed by the convex portion 44 of the second shutter member 41, and the third latch member 77 is not deflected. Therefore, the first latch member 78 is not pushed by the third latch member 77, and the first latch member 78 is not deflected.

Accordingly, the latch members 47, 68, 73, 77 and 78 are not deflected while the image forming apparatus is stored for a long time. Therefore, creep deformation of the latch members 47, 68, 73, 77 and 78 can be prevented.

Description will be made to an operation for switching from the state where the developer cartridge 60 is fixed to the developing device main body 30*a* (FIG. 5C) to a state where the developer cartridge 60 is detachable from the developing device main body 30*a* (FIG. 5A).

When the shutter member 65 of the developer cartridge 60 moves in the direction S1 (FIG. 5A), the second latch member 68 of the first shutter member 64 moves along inclined surfaces 95 and 97 of the stopper member 69 (FIG. 20C) of the outer circumference 61 and the stopper member 49 (FIG. 20C) of the second shutter member 41 while being deflected. In this state, as the first shutter member 65 moves, the third larch member 77 (FIGS. 19A and 19B) and the fifth latch member 73 (FIG. 18A) of the first shutter member 65 also move.

The fifth latch member 73 is pushed by the convex portion 74 of the developer cartridge 60, and pushes the fourth latch member 47 of the developing device main body 30*a* as shown in FIG. 18A, with the result that the fourth latch member 47 of the second shutter 41 is released from the latch restricting member 52.

The third latch member 77 of the first shutter member 65 is pushed by the convex portion 44 of the second shutter member 41, and pushes the first latch member 78 of the outer circumference 61 as shown in FIGS. 19A and 19B, with the result that the first latch member 78 is released from the latch restricting rib 82 of the first shutter member 65. That is, the developer cartridge 60 becomes detachable from the developing device main body 30*a*.

Further, the user can switch from the state where the developer cartridge 60 is fixed to the developing device main body 30*a* (FIG. 5C) to the state where printing can be performed (FIG. 5B) by one sliding (moving) operation of the first shutter member 65.

Furthermore, the state where the developer cartridge 60 is fixed to the developing device main body 30*a* (FIG. 5C) is not reached while the user moves the first shutter member 65 in a normal mounting and detaching operation. This is because the second latch member 68 of the first shutter member 65 is prevented from moving in the direction S2 (FIG. 5A) by contacting the contact surfaces 96 and 94 of the stopper members 49 and 69 as shown in FIGS. 20A and 20B.

In the above described configuration, the latch restricting portion 52 and the fourth latch member 47 constitute a second lock portion. The fourth latch member 47 is composed of a resilient material. The fifth latch member 73 and the convex portion 74 constitute a second lock releasing portion. The fifth latch member 73 is composed of a resilient material. The second lock releasing portion releases a locking by the second lock portion as follows. First, as shown in FIG. 18A, the fifth latch member 73 is pushed by the convex portion 74 and is resiliently deflected. Next, the fifth latch member 73 pushes the fourth latch member 47 to cause the fourth latch member 47 to be resiliently deflected, so as to release the fourth latch member 47 from the latch restricting portion 52. In other words, the second lock releasing portion applies a force to the second lock portion to release the locking by the second lock portion.

Further, the first latch member 78 and the latch restricting rib 82 constitute a first lock portion. The first latch member 78 is composed of a resilient material. The third latch member 77 and the convex portion 44 constitute a first lock releasing portion. The third latch member 77 is composed of a resilient material. The third latch releasing portion releases a locking by the first lock portion as follows. First, as shown in FIGS. 19A and 19B, the third latch member 77 is pushed by the convex portion 44, and is resiliently deflected. Next, the third latch member 77 pushes the first latch member 78 to cause the first latch member 78 to be resiliently deflected, so as to release the first latch member 78 from the latch restricting rib 82. In other words, the first lock releasing portion applies a force to the first lock portion to release the locking by the first lock portion.

Further, the second latch member 68 and the stopper member 69 constitute a third lock portion. The second latch member 68 and the stopper member 69 also constitute a third lock releasing portion. When the first shutter member is moved from the third position (FIG. 20C) to the first position shown (FIG. 20B), the second latch member is pushed by the second inclined surface 95 of the stopper member 69 and is resiliently deflected, so that the engagement between the second latch member 68 and the stopper member 69 is released.

Advantages of First Embodiment

According to the developer cartridge 60, the developing device 30 and the image forming apparatus of the first embodiment, the following advantages are obtained.

(1) The first shutter member 65 for opening and closing the supplying opening 64 is mounted on the developer cartridge 60 so as to be slidable in the longitudinal direction of the developer cartridge 60. The first shutter member 65 has the first position where the first shutter member 65 opens the supplying opening 64 and causes the developer cartridge 60 to be fixed to the developing device main body 30*a*, the second position where the first shutter member 65 closes the supplying opening 64 and makes the developer cartridge 60 detachable from the developing device main body 30*a*, and the third position where the first shutter member 65 closes the supplying opening 64 and causes the developer cartridge 60 to be fixed to the developing device main body 30*a*. Accordingly, the developer cartridge 60 can be fixed to the developing device main body 30*a* with a simple structure.

(2) The developer cartridge 60 can be easily fixed to the developing device main body 30*a*, and therefore the image forming apparatus can be transported in a state where the developer cartridge 60 is mounted to the developing device main body 30*a*.

(3) After the image forming apparatus has been transported, when the user sets up the image forming apparatus, the user is only needed to move the first shutter member 65 of the developer cartridge 60 from the third position to the first position. The user is not needed to detach any part of the image forming apparatus, and therefore unnecessary part is not produced. Accordingly, handling by the user can be facilitated, and cost can be reduced.

(4) The first shutter member 65 is provided at the substantial center of the developer cartridge 60, and therefore the moving amount of the first shutter member 65 can be easily recognized.

(5) The first shutter member 65 has the operating portion 65*a* and has a size such that the user can operate the first shutter member 65 in one hand, and therefore the user can easily apply a force to the first shutter member. That is, the user can easily and smoothly operate the first shutter member.

(6) The mounting holes 42 and the protrusions 80 are located on the first position side, and the convex portion 70 and the guiding portion 54 are located on the third position side. Therefore, when the user moves the first shutter member 65 from the second position (or the third position) to the first position, the first shutter member 65 moves in such a manner that the protrusions 80 abut against the mounting holes 42. Therefore, a state where the developing cartridge 60 is unlikely to move upward from the developing device main body 30*a* is maintained while the first shutter member 65 moves.

Second Embodiment

Configuration of Second Embodiment

Figure 21A:
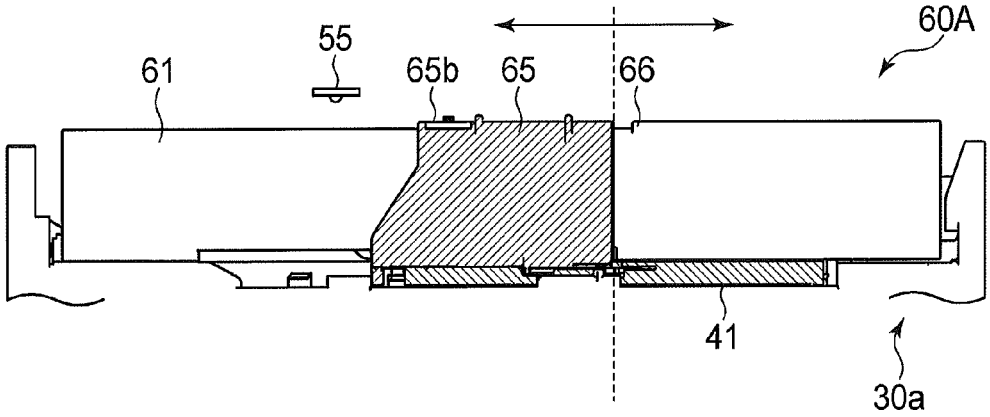
FIGS. 21A, 21B and 21C are schematic views showing a first shutter member and a second shutter member according to the second embodiment of the present invention.
Figure 21B:
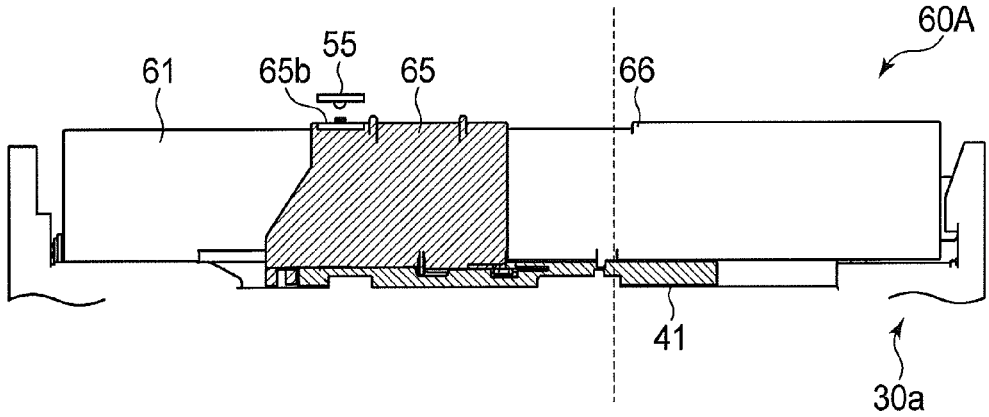
Figure 21C:
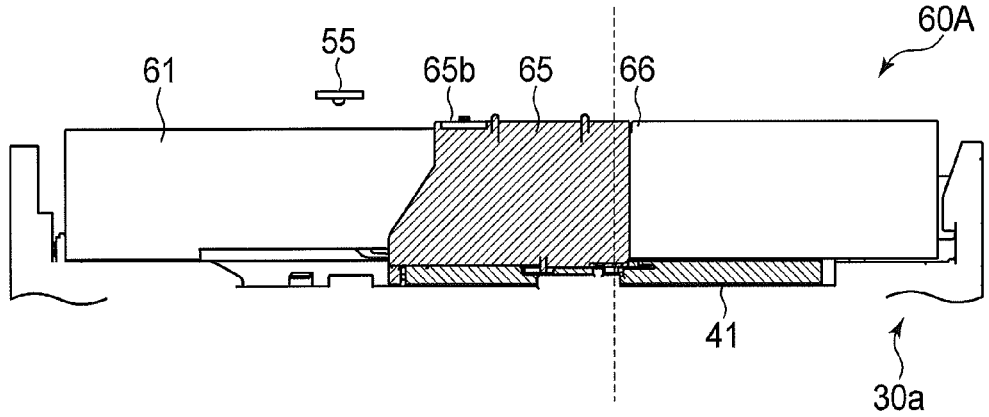

FIGS. 21A, 21B and 21C are schematic views showing the first shutter member 65 and the second shutter member 41 according to the second embodiment of the present invention.

The developer cartridge 60A, the developing device and the image forming apparatus of the second embodiment are the same as those of the first embodiment except for the first shutter member 65 and the second shutter member 41.

The shutter member 65 of the developer cartridge 60A of the second embodiment has a determination member 65*b* (i.e., an information storage portion) that stores information of the developer cartridge 60. The image forming apparatus of the second embodiment has a determination sensor 55 (i.e., a reading portion) that reads the information stored in the determination member 65*b*.

When the first shutter member 65 is located in the first position shown in FIG. 21B (i.e., the printing enabling position), the determination sensor 55 and the determination member 65*b* are located so that the determination sensor 55 can read the information of the determination member 65*b*.

The determination member 65*b* includes, for example, EEPROM (Electrically Erasable Programmable Read-Only Memory) as a nonvolatile memory, RF-ID (Radio Frequency Identification) as an electronic tag or the like. The determination member 65*b* stores information of the developer cartridge 60 such as newness/oldness of the developer, a color of the developer, and a capacity of the developer cartridge 60.

The configuration of the second embodiment is the same as that of the first embodiment in other respects.

Operation of Second Embodiment

An operation of the developer cartridge 60 of the second embodiment will be described with reference to FIGS. 21A, 21B and 21C.

When the first shutter member 65 of the developer cartridge 60 moves, the determination member 65*b* mounted to the first shutter member 65 also moves. When the first shutter member 65 is in the first position as the printing enabling position (FIG. 21B), the determination member 65*b* is aligned with the determination sensor 55, and therefore the determination sensor 55 can read the information stored in the determination member 65*b*. If the information read by the determination sensor 55 shows no abnormality, the image forming apparatus performs printing operation.

When the first shutter member 65 is in the second or third position (FIGS. 21A and 21C), the determination member 65*b* is not aligned with the determination sensor 55, and therefore the determination sensor 55 cannot read the information stored in the determination member 65*b*. In this case, the image forming apparatus does not perform the printing operation. With such a configuration, the determination whether the first shutter member 65 is in the first position (i.e., the printing enabling position) or not is performed at the same time as the determination based on the information read by the determination sensor 55.

Advantages of Second Embodiment

According to the second embodiment, the following advantage is obtained in addition to the advantages of the first embodiment.

That is, whether the first shutter member 65 is in the first position or not can be determined. In other words, whether the first shutter member 65 closes the supplying opening 64 or not can be determined. Therefore, it becomes possible to prevent an image blurring caused by failure to fully open the supplying opening 64.

Third Embodiment

Configuration of Third Embodiment

Figure 19E:
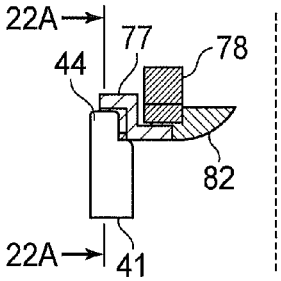
Figure 22A:
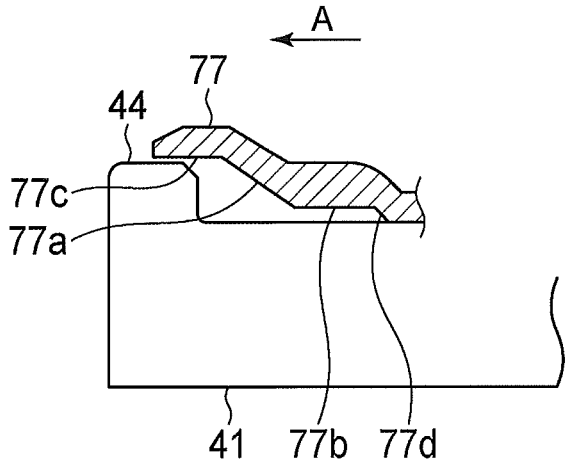
FIGS. 22A, 22B and 22C are sectional views showing operations of a third latch member and a convex portion according to the third embodiment of the present invention.
Figure 22B:
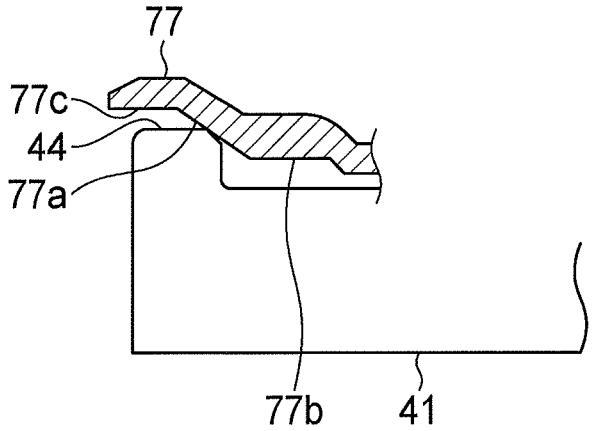
Figure 22C:
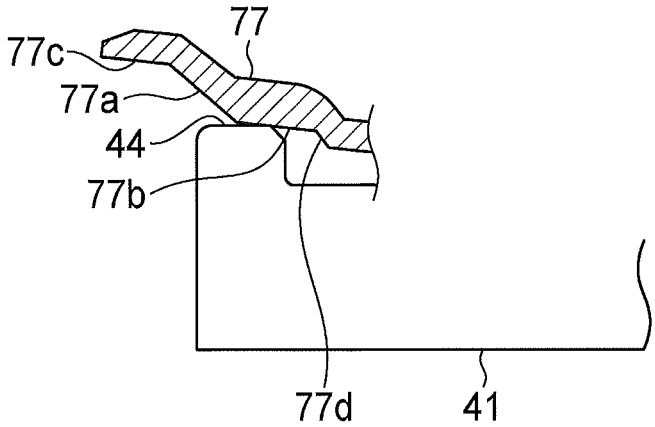

FIGS. 22A, 22B and 22C are sectional views taken along line 22A-22A in FIG. 19E for illustrating the third latch member 77 of the first shutter member 65 and the convex portion 44 of the second shutter member 41 according to the third embodiment of the present invention.

FIG. 22A shows the state where the first shutter member 65 is in the third position (i.e., the fixing position). In the third embodiment, the third latch member 77 has contact surfaces 77*b* and 77*c*. The contact surface 77*b* protrudes toward the convex portion 44 with respect to the contact surface 77*c*. An inclined surface 77*a* is formed so as to connect the contact surfaces 77*b* and 77*c*. The contact surface 77*b* is located on an upstream side with respect to the contact surfaces 77*a* and 77*c* in a direction A corresponding to a direction in which the first shutter member 65 moves to open the supply opening 67.

In the third position (i.e., the fixing position) shown in FIG. 22A, the contact surface 77*c* and the convex portion 44 are in a positional relationship such that the convex portion 44 does not push the contact surface 77*c*. For example, the contact surface 77*c* is slightly apart from the convex portion 44. Therefore, the third latch member 77 is not pushed by the convex portion 44, and the third latch member 77 is not resiliently deflected (deformed).

FIG. 22B corresponds to a state where the first shutter member 65 is on the way from the third position (i.e., the fixing position) to the second position (i.e., the detachable position). In this state, the convex portion 44 contacts and pushes the inclined surface 77*a* of the third latch member 77, and causes the third latch member 77 to be resiliently deflected.

FIG. 22C corresponds to a state where the first shutter member 65 reaches the second position (i.e., the detachable position). In this state, the convex portion 44 contacts and pushes the contact surface 77*b* of the third latch member 77, and causes the third latch member 77 to be resiliently deflected. As described in the first embodiment, when the first shutter member 65 reaches the second position (i.e., the detachable position), the first latch member 78 is released from the latch restricting rib (FIG. 19B). Therefore, the first shutter member 65 becomes movable toward the first position (i.e., the printing enabling position).

In this embodiment, the third latch member 77 further has an abutting portion 77*d*. When the first shutter member 65 moves toward the first position from the second position (FIG. 22C), the convex portion 44 abuts against the abutting portion 77*d* of the third latch member 77, with the result that the first shutter member 65 and the second shutter member 41 move together with each other. However, this embodiment is not limited to such a configuration. For example, it is also possible that the first shutter member 65 and the second shutter member 41 move together with each other by a friction force between the contact surface 77*b* of the third latch member 77 and the convex portion 44 caused by resilient forces of the third latch member 77 and first latch member 78.

The configuration of the third embodiment is the same as that of the first embodiment in other respects.

Operation of Third Embodiment

Next, an operation of the third embodiment will be described.

When the first shutter member 65 is in the third position (i.e., the fixing position), the convex portion 44 of the second shutter member 41 does not push the third latch member 77. Therefore, the third latch member 77 is not resiliently deflected. Further, since the third latch member 77 is not resiliently deflected, the contact portion 77*e* of the third latch member 77 does not push the contact portion 78*a* (FIG. 19F) of the first latch member 78. Therefore, the first latch member 78 is not resiliently deflected.

Figure 19F:
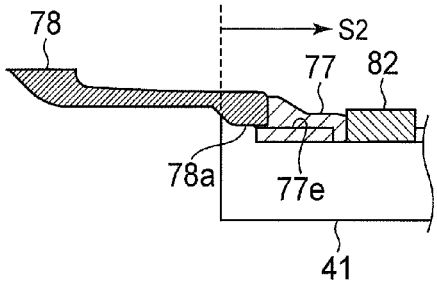

Accordingly, even if the developing device 30 is left for a long time in a state where the developer cartridge 60 is fixed to the developing device main body 30*a* (i.e., in a state where the first shutter member 65 is in the third position as shown in FIGS. 19E and 19F), creep deformation of the first latch member 78 can be prevented.

Figure 23:
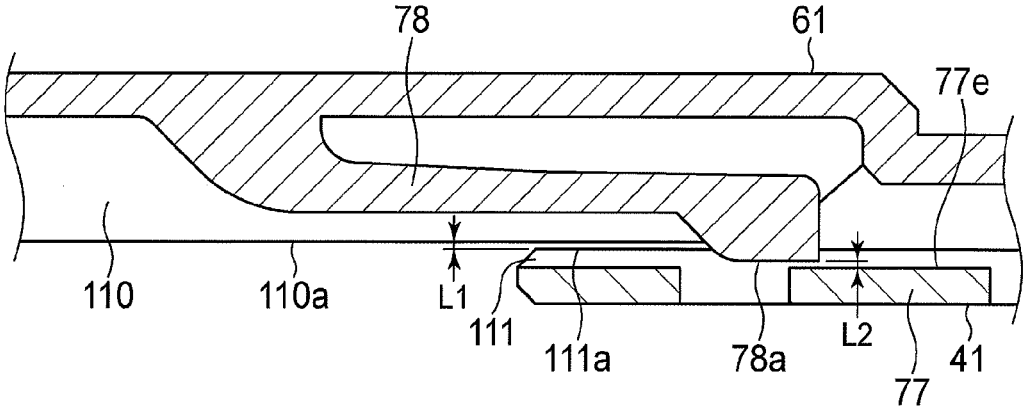
FIG. 23 is a sectional view taken along line 10B-10B in FIG. 10A.

FIG. 23 is a sectional view showing the first latch member 78 and the third latch member 77 according to the third embodiment. FIG. 23 corresponds to the sectional view taken along line 10B-10B in FIG. 10A. As shown in FIG. 23, the outer circumference 61 of the develop cartridge 60 has a rib 110 as a first restricting portion having a contact portion 110*a*. The first shutter member 65 has a rib 111 as a second restricting portion having a contact portion 111*a*. A distance between the contact portions 110*a* and 111*a* is expressed as L1. A distance between the contact portions 78*a* and 77*e* of the first latch member 78 and the third latch member 77 is expressed as L2. It is preferable that the distance L1 is smaller than or equal to the distance L2 (L1≤L2). This is because the distance between the contact portions 78*a* and 77*e* of the first latch member 78 and the third latch member 77 is ensured by a contact between the ribs 110 and 111. Therefore, it is ensured that the first latch member 78 is not resiliently deflected unless the third latch member 77 is deflected by being pressed by the convex portion 44 of the second shutter member 41. Accordingly, the prevention of the creep deformation of the first latch member 78 can be ensured. In this embodiment, for example, the distance L1 and the distance L2 are set to be same (L1=L2).

In the third embodiment, the resilient deflection of the first latch member 78 (caused by being pressed by the third latch member 77) when the first shutter member 65 is in the third position (i.e., the fixing position) is restricted. However, the third embodiment is not limited to such a configuration. For example, it is also possible that a deflection amount D (i.e., a deformation amount) of the first latch member 78 required to release the first latch member 78 from the latch restricting rib 82 (FIGS. 19A and 19B) is larger than a deflection amount E of the first latch member 60 when the first shutter member 65 is in the third position (FIGS. 19E and 19F). Such a configuration is advantageous in reducing the creep deformation of the first latch member 78 when the developing device 30 is left for a long time in a state where the developer cartridge 60 is fixed to the developing device main body 30*a*.

As described in the first embodiment, in the third embodiment, the latch restricting portion 52 and the fourth latch member 47 constitute a second lock portion. The fourth latch member 47 is composed of a resilient material. The fifth latch member 73 and the convex portion 74 constitute a second lock releasing portion. The fifth latch member 73 is composed of a resilient material. The second lock releasing portion releases a locking by the second lock portion as follows. First, as shown in FIG. 18A, the fifth latch member 73 is pushed by the convex portion 74 and is resiliently deflected. Next, the fifth latch member 73 pushes the fourth latch member 47 to cause the fourth latch member 47 to be resiliently deflected, so as to release the fourth latch member 47 from the latch restricting portion 52.

Further, the first latch member 78 and the latch restricting rib 82 constitute a first lock portion. The first latch member 78 is composed of a resilient material. The third latch member 77 and the convex portion 44 constitute a first lock releasing portion. The third latch member 77 is composed of a resilient material. The third latch releasing portion releases a locking by the first lock portion as follows. First, as shown in FIGS. 19A and 19B, the third latch member 77 is pushed by the convex portion 44, and is resiliently deflected. Next, the third latch member 77 pushes the first latch member 78 to cause the first latch member 78 to be resiliently deflected, so as to release the first latch member 78 from the latch restricting rib 82. In other words, the first lock releasing portion applies a force to the first lock portion to release the locking by the first lock portion. In the third embodiment, when the first shutter member 65 is in the third position (i.e., the fixing position), the first lock releasing portion does not apply a force to the first lock portion. Further, the first lock releasing portion applies a force to the first lock portion while the first shutter member 65 moves from the third position to the first position (i.e., the detachable position).

Further, the second latch member 68 and the stopper member 69 constitute a third lock portion. The second latch member 68 and the stopper member 69 also constitute a third lock releasing portion. When the first shutter member moves from the third position (FIG. 20C) to the first position (FIG. 20B), the second latch member 68 is pushed by the second inclined surface 95 of the stopper member 69 and is resiliently deflected, so that the engagement between the second latch member 68 and the stopper member 69 is released.

Advantages of Third Embodiment

As described above, according to the third embodiment, even if the developing device 30 is left for a long time in a state where the developer cartridge 60 is fixed to the developing device main body 30*a*, creep deformation of the first latch member 78 can be prevented.

Further, as the creep deformation of the first latch member 78 is prevented, the first shutter member 65 is prevented from being unintentionally moved. Therefore scattering of the developer can be prevented.

Modification.

Figure 24:
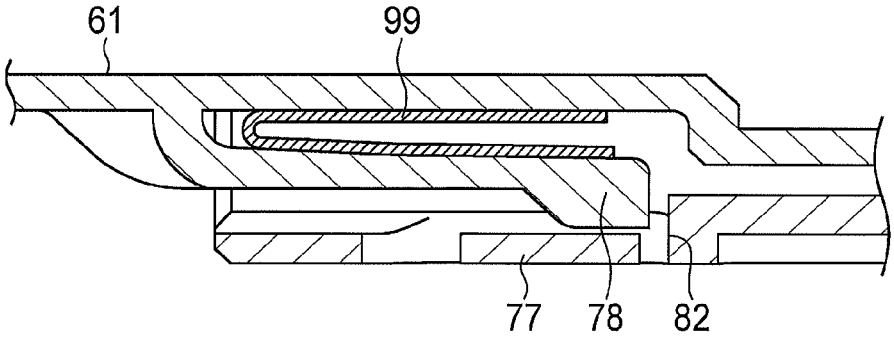
FIG. 24 is a sectional view showing a modification applicable to the third embodiment.

FIG. 24 shows a modification applicable to the third embodiment.

In this modification, a biasing member 99 (i.e., a reinforcing member) is mounted to the first latch member 78. The biasing member 99 has a U-shape, and is composed of a metal such as a stainless steel (SUS). For example, the biasing member 99 is made of a sheet metal.

When the first latch member 78 is deflected by being pushed by the third latch member 77 (in a direction in which the first latch member 78 is released from the latch restricting rib 82), the biasing member 99 applies a force to the first latch member 78 in a direction opposite to a deflection to the first latch member 78. In other words, the biasing member 99 applies a force in a direction to push back the first latch member 78 to a position where the first latch member 78 engages the latch restricting rib 82.

According to the modification, the biasing member 99 made of metal (such as a sheet metal of stainless steel) is provided, which applies a force to the first latch member 78 in a direction opposite to the deflection of the first latch member 78. Therefore, the prevention of the creep deformation of the first latch member 78 can be ensured.

Fourth Embodiment

Configuration of Fourth Embodiment

FIGS. 25A, 25B, 25C and 25D are schematic views showing operations of the fourth latch member 47, the fifth latch member 73, the convex portion 74 and the latch restricting portion 52 according to the fourth embodiment of the present invention.

In the above described first embodiment, the lock of the second shutter member 41 is released substantially when the developer cartridge 60 is mounted to the developing device main body 30*a* as shown in FIG. 18A. However, if an external force is applied to the second shutter member 41 when the developer cartridge 60 is being detached from the developing device main body 30*a*, there is a possibility that the second shutter member 41 may unintentionally move. In such a case, when the developer cartridge 60 is mounted to the developing device main body 30*a*, the third latch member 77 (FIGS. 19A and 19B) of the first shutter member 65 may not be aligned with the convex portion 44. Therefore, there is a possibility that the first shutter member 65 does not move in normal way.

Figure 25A:
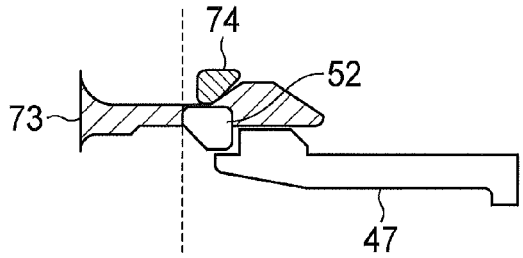
FIGS. 25A, 25B, 25C and 25D are schematic views showing operations of a fourth latch member, a fifth latch member, a convex portion and a latch restricting portion according to the fourth embodiment of the present invention.

Therefore, in the fourth embodiment, the lock of the second shutter member 41 is not released when the first shutter member 65 is in the second position (i.e., the detachable position) as shown in FIG. 25A. In other words, when the fixing portions 43 and 76 (FIG. 14B) do not engage each other and when the fixing portions 50 and 76 (FIG. 16D) do not engage each other, the lock of the second shutter member 41 is not released.

Figure 25B:
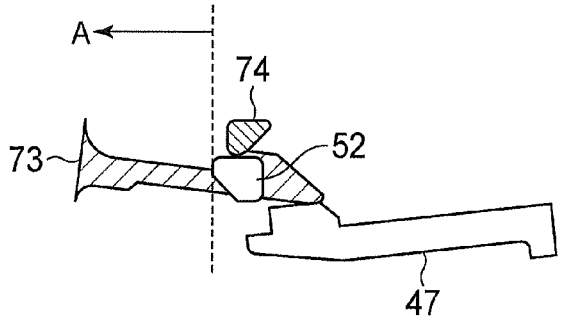
Figure 25C:
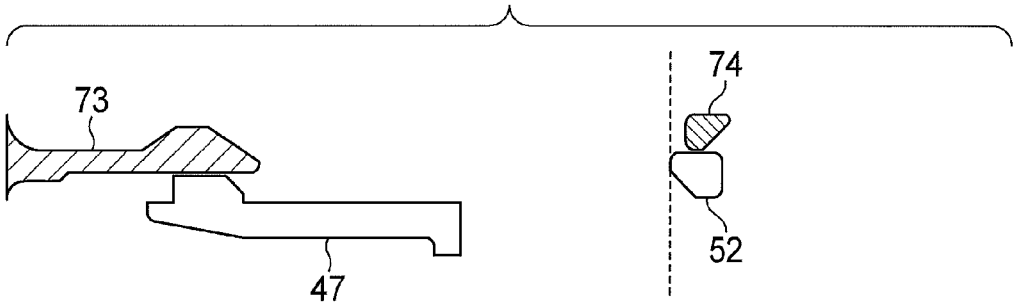
Figure 25D:
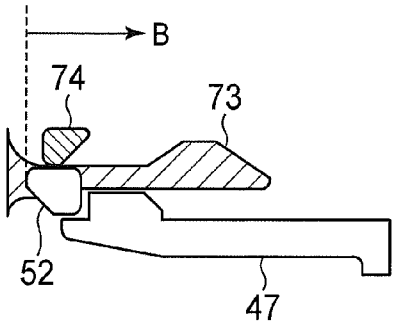

FIG. 25A shows the state where the developer cartridge 60 is mounted to the developing device main body 30*a*, i.e., a state where the first shutter member 65 is in the second position (i.e., the detachable position). FIG. 25B shows a state where the first shutter member 65 moves from the second position toward the first position (i.e., the printing enabling position). FIG. 25C shows a state where the first shutter member 65 reaches the first position (i.e., the printing enabling position). FIG. 25D shows a state where the first shutter member 65 reaches the third position (i.e., the fixing position).

In the fourth embodiment, while the first shutter member 65 moves from the second position (FIG. 25A) to the first position (FIG. 25C), the fifth latch member 73 of the first shutter member 65 engages the convex portion 74 of the outer circumference 61 of the developer cartridge 60, is resiliently deflected as shown in FIG. 25B, and pushes the fourth latch member 47. The fourth latch member 47 pushed by the fifth latch member 73 is resiliently deflected, and is released from the latch restricting portion 52.

The configuration of the fourth embodiment is the same as the first embodiment in other respects.

Advantages of Fourth Embodiment

According to the fourth embodiment, the lock of the second shutter member 41 is not released when the first shutter member 65 is in the second position (i.e., the detachable position). Therefore, the second shutter member 41 is prevented from being unintentionally opened during the detaching operation of the developer cartridge 60. As a result, reliability of detaching and mounting operation can be enhanced.

Various modifications and improvements may be made to the above described embodiments.

In the above described, the color printer has been described as an example of the image forming apparatus. However, the present invention is not limited to such a configuration, but is applicable to a facsimile machine, a copier, a MFP (Multi Function Peripheral) and the like.

Further, in the above described embodiments, the storage portion 62 of the developer cartridge 60 has the substantially cylindrical shape. However, it is also possible that the developer cartridge 60 has circular cross section or any polygonal cross section.

While the preferred embodiments of the present invention have been illustrated in detail, it should be apparent that modifications and improvements may be made to the invention without departing from the spirit and scope of the invention as described in the following claims.

What is claimed is:

1. A developer cartridge detachably mounted to a main apparatus, said developer cartridge comprising:

a storage portion in which a developer is stored;

an ejection opening that ejects said developer from said storage portion; and a first opening-and-closing member that opens and closes said ejection opening;

wherein said first opening-and-closing member is slidable to:

a first position where said first opening-and-closing member opens said ejection opening and causes said developer cartridge to be fixed to said main apparatus;

a second position where said first opening-and-closing member closes said ejection opening and makes said developer cartridge detachable from said main apparatus; and a third position where said first opening-and-closing member closes said ejection opening and causes said developer cartridge to be fixed to said main apparatus.

2. The developer cartridge according to claim 1, wherein:

said first opening-and-closing member includes an engaging section that engages a to-be-engaged section of a second opening-and-closing member of said main apparatus;

when said first opening-and-closing member moves from said first position toward said second position, said engaging section engages said to-be-engaged section to cause said first opening-and-closing member and said second opening-and-closing member to move together; and when said first opening-and-closing member moves from said second position toward said third position, said engaging section releases engagement with said to-be-engaged section to cause said first opening-and-closing member to move without causing said second opening-and-closing member to move.

3. The developer cartridge according to claim 2, wherein said storage portion has a cylindrical shape whose both ends are closed;

wherein said ejection opening is formed on an outer circumference of said storage portion; and wherein said second position is located on a substantially center portion of said outer circumference in a longitudinal direction of said storage portion.

4. The developer cartridge according to claim 3, further comprising:

a first latch member provided on said outer circumference; and a first stopper member provided on said opening-and-closing member, said first stopper member contacting said first latch member to restrict a movement of said first opening-and-closing member from said second position to said first position.

5. A developing device being said main apparatus to which said developer cartridge according to claim 4 is mounted, said developing device comprising:

a developing device main body to which said developer cartridge is detachably mounted;

wherein said first latch member is made of a resilient member;

wherein said first latch member is released from said first stopper member by being deformed with a predetermined amount; and wherein, when said first opening-and-closing member is in said third position, said first latch member is not deformed or is deformed with a smaller amount than said predetermined amount.

6. The developer cartridge according to claim 2, further comprising:

a first engaging portion provided on said first opening-and-closing member, said first engaging portion engaging said main apparatus at said first position; and a second engaging portion provided on said first opening-and-closing member, said second engaging portion engaging said main apparatus at said third position.

7. The developer cartridge according to claim 2, wherein said first position is located on one side of said second position, and said third position is located on the other side of said second position.

8. A developing device being said main apparatus to which said developer cartridge according to claim 2 is mounted, said developing device comprising a developing device main body to which said developer cartridge is detachably mounted.

9. The developing device according to claim 8, wherein said developing device main body comprises:

a receiving opening for receiving said developer ejected from said developer cartridge; and a second opening-and-closing member that opens and closes said receiving opening in conjunction with a movement of said first opening-and-closing member.

10. The developing device according to claim 9, wherein said second opening-and-closing member does not move in conjunction with a movement of said first opening-and-closing member to said third position.

11. The developing device according to claim 8, further comprising:

a first engaging portion provided on said first opening-and-closing member, said first engaging portion engaging said main apparatus at said first position;

a second engaging portion provided on said first opening-and-closing member, said second engaging portion engaging said main apparatus at said third position;

a third engaging portion that engages said first engaging portion; and a fourth engaging portion that engages said second engaging portion.

12. The developing device according to claim 8, further comprising:

a first stopper member provided on said opening-and-closing member, said first stopper member contacting said first latch member to restrict a movement of said first opening-and-closing member from said second position to said first position;

a first latch member provided on said outer circumference;

a third latch member provided on said first opening-and-closing member and configured to release said first latch member from said first stopper member; and a first releasing portion provided on said second opening-and-closing member and configured to release said first latch member from said first stopper member wherein said third latch member is provided between said first latch member and said first releasing portion when said first opening-and-closing member is in said second position; and wherein said third latch member is pushed by said first releasing portion, and thereby pushes said first latch member so as to release said first latch member from said first stopper member.

13. The developing device according to claim 12, further comprising:

a fourth latch member provided on said second opening-and-closing member;

a fifth latch member provided on said first opening-and-closing member; and a fourth stopper member that contacts said fifth latch member to restrict a movement of said first opening-and-closing member from said second position to said first position.

14. The developing device according to claim 13, wherein, when said first opening-and-closing member is in said third position, said first latch member is in a position in which said first latch member is not pushed by said first releasing portion.

15. The developing device according to claim 12, further comprising:

a fifth latch member provided between said fourth latch member and said second releasing portion when said first opening-and-closing member is in said second position; and a second releasing portion provided on said outer circumference of said storage portion;

wherein said fifth latch member is pushed by said second releasing portion, and thereby pushes said fourth latch member to release said fourth latch member from said fourth stopper member.

16. The developing device according to claim 8, further comprising:

a protrusion provided on an end portion of said storage portion on said first position side;

a hole formed on said developing device main body into which said protrusion is inserted;

a convex portion provided on the other end portion of said storage portion on said third position side; and a guide portion provided on said developing device main body so as to guide a movement of said convex portion.

17. An image forming apparatus comprising:

said developing device according to claim 8; and an image forming portion in which a developer image developed by said developing device is formed on a printing medium.

18. The image forming apparatus according to claim 17, further comprising:

an information storage portion provided on said first opening-and-closing member, said information storage portion storing information regarding said developer cartridge; and a reading portion for reading said information.

19. The image forming apparatus according to claim 18, wherein said reading portion becomes able to read said information when said first opening-and-closing member is in said first position.

20. The image forming apparatus according to claim 18, wherein said information storage portion comprises an electronic tag or nonvolatile memory.

21. The developing device being said main apparatus to which said developer cartridge according to claim 2 is mounted, said developing device comprising:

a developing device main body to which said developer cartridge is detachably mounted;

a receiving opening for receiving said developer ejected by said ejection opening;

a second opening-and-closing member that opens and closes said receiving opening in conjunction with a movement of said first opening-and-closing member;

a lock portion that restricts a movement of said second opening-and-closing member; and a lock releasing portion that releases a locking by said lock portion;

wherein said lock releasing portion releases said locking by said lock portion in a process where said first opening-and-closing member moves from said second position toward said first position.

22. A developer cartridge detachably mounted to a main apparatus, said developer cartridge comprising:

a storage portion in which a developer is stored;

an ejection opening that ejects said developer from said storage portion; and a first opening-and-closing member that opens and closes said ejection opening, said first opening-and-closing member including an engaging section that engages a to-be-engaged section of a second opening-and-closing member of said main apparatus;

wherein said first opening-and-closing member is slidable to:

a first position where said first opening-and-closing member opens said ejection opening and causes said developer cartridge to be fixed to said main apparatus;

a second position where said first opening-and-closing member closes said ejection opening and makes said developer cartridge detachable from said main apparatus; and a third position where said first opening-and-closing member closes said ejection opening and causes said developer cartridge to be fixed to said main apparatus;

wherein when said first opening-and-closing member moves from said first position toward said second position, said engaging section engages said to-be-engaged section to cause said first opening-and-closing member and said second opening-and-closing member to move together; and wherein when said first opening-and-closing member moves from said second position toward said third position, said engaging section releases engagement with said to-be-engaged section to cause said first opening-and-closing member to move without causing said second opening-and-closing member to move.

* * * * *